US008064631B2

(12) United States Patent
Hanada

(10) Patent No.: US 8,064,631 B2
(45) Date of Patent: Nov. 22, 2011

(54) ELECTROACOUSTIC TRANSDUCER

(76) Inventor: Akito Hanada, Kitakyushu (JP)

( * ) Notice: Subject to any disclaimer, the term of this patent is extended or adjusted under 35 U.S.C. 154(b) by 264 days.

(21) Appl. No.: 12/522,986

(22) PCT Filed: Jan. 9, 2008

(86) PCT No.: PCT/JP2008/050102

§ 371 (c)(1),
(2), (4) Date: Jul. 13, 2009

(87) PCT Pub. No.: WO2008/084796

PCT Pub. Date: Jul. 17, 2008

(65) Prior Publication Data

US 2010/0278371 A1 Nov. 4, 2010

(30) Foreign Application Priority Data

Jan. 11, 2007 (WO) ..... PCT/JP2007/050274

(51) Int. Cl.
*H04R 1/00* (2006.01)
*H04R 9/06* (2006.01)
*H04R 11/02* (2006.01)

(52) U.S. Cl. ..... 381/421; 381/412

(58) Field of Classification Search ..... 381/152, 381/191, 396, 412–422, 431
See application file for complete search history.

(56) References Cited

U.S. PATENT DOCUMENTS 4,315,112 A * 2/1982 Hofer ..... 381/186
5,425,107 A * 6/1995 Bertagni et al. ..... 381/426
7,142,687 B2 * 11/2006 Hanada ..... 381/421

FOREIGN PATENT DOCUMENTS

JP 35-010420 B 3/1958
JP 60-093397 U 6/1985
JP 3612319 B2 10/2004

* cited by examiner

*Primary Examiner* — Tuan Nguyen
(74) *Attorney, Agent, or Firm* — Sughrue Mion, PLLC

(57) ABSTRACT

The invention provides an electroacoustic transducer capable of efficiently carrying out conversion from electric signals to sound or from sound to electric signals at low distortion, which requires no special shape nor processing as a magnet, requires no minute setting of the magnetization direction, and sets a distribution of higher magnetic flux densities for effective action with respect to an electric conductor of an acoustic diaphragm than in a magnet plate magnetized in the radius direction although the production process thereof is remarkably simple as in a magnet plate magnetized in the radius direction.

7 Claims, 6 Drawing Sheets

ELECTROACOUSTIC TRANSDUCER

TECHNICAL FIELD

The present invention relates to an electroacoustic transducer that is applied to a speaker, a headphone, an earphone, etc., for converting electric signals into sound, or a microphone and an acoustic wave sensor, etc., for converting received sound into electric signals.

BACKGROUND ART

Conventionally, in an electroacoustic transducer called "Gamuzon type speaker," such a type has been used, in which an acoustic diaphragm on which a flat coil pattern of an electric conductor corresponding to a voice coil is formed is installed at a pair of intermediate parts of a magnetic field generator, and a drive current is supplied to the electric conductor, wherein the acoustic diaphragm is vibrated in the perpendicular direction to the plane thereof.

The acoustic diaphragm of the Gamuzon type speaker is structured so that an electric conductor is disposed almost on the entire surface of the acoustic diaphragm, and is featured in that the entire surface is driven at the same phase and favorable transient characteristics may be obtained at a wide range.

For example, (Patent Document 1) discloses an electroacoustic transducer, in which adjacent band-shaped magnets (or band-shaped areas in a magnet plate) are disposed with the N and S poles thereof made different alternately, the entirety of a magnet plate composed of a number of band-shaped magnets is formed to be like a flat plate, the N and S poles are disposed with the directions thereof made perpendicular to the flat plate surface, and an acoustic diaphragm, in which electric conductors are formed, is disposed opposite to the flat surface of the magnet plate.

In the electroacoustic transducer, since the N and S poles are disposed with the directions thereof made different alternately, there are many parts where the directions of the magnetic field are inverted on the acoustic diaphragm and many parts where the magnetic flux density is low. Therefore, the density of magnetic flux to drive the acoustic diaphragm in the direction perpendicular to the plane, that is, the density (hereinafter called a "magnetic flux density for effective action") of magnetic flux (hereinafter called a "magnetic flux for effective action") by which the electromagnetic force operating on the electric conductors of the acoustic diaphragm is turned into the vibration direction was subjected to a large change. Also, it was necessary that the winding direction of the electric conductor is inverted in accordance with the direction of inverting magnetic fields and that the electric conductors are arranged in accordance with a partially existing area where the magnetic flux density for effective action is high. Therefore, it is not possible to form the entire surface of the diaphragm of a planar coil, and a supporting member such as a synthetic resin sheet to support the planar coil is indispensable. Sound inherent to the supporting member adversely influences the sound quality. Further, there is another problem that great unevenness is brought about in the drive force of respective parts of the diaphragm, which becomes a factor by which separate vibrations become a critical problem for reproduction of high quality sound.

Further, (Patent Document 2) discloses an electroacoustic transducer in which two magnet plates having a columnar-shaped magnet and a ring-shaped magnet separately arranged concentrically at the center side and the outer circumference side are opposed to each other, an acoustic diaphragm (planar coil diaphragm) having electric conductors spirally printed thereon is disposed between the two magnet plates parallel to the magnet plates, and the polarities are inverted at the center side and the outer circumference portion with the magnetization direction of magnets turned into the direction perpendicular to the acoustic diaphragm.

In the electroacoustic transducer, since the electric conductors are spirally wound in the same direction, it becomes possible to form the entire surface of the diaphragm of a planar coil. Therefore, it becomes possible that a drive force may be generated on the entire surface of the diaphragm, wherein this is effective in response to such a problem as in (Patent Document 1). However, since the area at which the magnetic flux density is high is made very narrow in the arrangement of magnets the magnetization direction of which is brought into only the direction perpendicular to the diaphragm, it was impossible to widen the area of the diaphragm. Therefore, it is difficult to adopt the electroacoustic transducer as a low frequency range speaker for which the diameter of the diaphragm is increased, wherein use is restricted to a high frequency range speaker in order to use in a state where the utilization efficiency of magnetic flux is high. In addition, since fluctuations in the magnetic flux density for effective action are large at respective positions of the planar coil, it is not possible to obtain a uniform drive force on the entire surface of the diaphragm, wherein a problem of separate vibrations could not be solved.

Thus, since the area at which the magnetic flux density for effective action is high becomes very narrow in prior art magnet plates the magnetization direction of which is brought into only the direction perpendicular to the diaphragm, it is not possible to widen the area of the diaphragm. Although in (Patent Document 2) the area is widened by widening the gap between the respective magnets at the center side and the outer circumference side, which become two partial areas, as a countermeasure, the magnetic flux density for effective action is lowered in this case, wherein the width is restricted. Finally, it is difficult to adopt such prior art electroacoustic transducers as a low frequency range speaker in which the diameter of the diaphragm is increased. In addition, in almost all cases since the magnetization direction is one direction, the distribution of the magnetic flux density for effective action is adjusted by varying the gap between two types of partial areas. With such restricted adjustment, it is difficult to make uniform the distribution of the magnetic flux density for effective action at respective positions of the acoustic diaphragm, and it is difficult to obtain a uniform drive force at the entire surface of the diaphragm.

In order to solve these problems in the prior arts, (Patent Document 3) that the present applicant earnestly researched and developed and to which a patent right was granted discloses an electroacoustic transducer in which, using a magnet plate (hereinafter called a "magnet plate of optimum magnetization angle") that is divided into a number of partial areas and the respective partial areas are turned into magnetization directions in order to increase the use efficiency of a magnet, an acoustic diaphragm in which an electric conductor is spirally wound is disposed parallel to the magnet plate at the front of the magnet plate. Also, the patent document further discloses an electroacoustic transducer having a similar acoustic diaphragm installed therein, using a magnet plate (hereinafter called a "magnet plate magnetized in the radius direction") in which a component parallel to the vibration plane of the acoustic diaphragm is turned into a radius direction of the magnet plate in the magnetization direction of the magnet plate, and in which the angles formed with respect to the vibration plane of the acoustic diaphragm are all fixed.

[Patent Document 1] Japanese Published Examined Patent Application No. S35-10420

[Patent Document 2] Japanese Published Unexamined Utility Model Application No. S60-93397

[Patent Document 3] Japanese Patent No. 3612319

DISCLOSURE OF THE INVENTION

Objects to be Solved by the Invention

A new magnet plate adopted in an electroacoustic transducer according to (Patent Document 3) has a novel feature by which high magnetic flux density for effective action in one direction may be uniformly formed over the entire surface of an acoustic diaphragm having a wide area. Therefore, the electroacoustic transducer has a feature greatly different from the prior arts, by which it is sufficient that the winding direction of a planar coil of the acoustic diaphragm is one direction, and the planar coil may be arranged in a very wide area over the entire surface of the acoustic diaphragm.

And, these features enable design of an acoustic diaphragm that is capable of driving the entire surface of the vibration plane at the same phase, to prevent distortion, which is brought about by a difference in height with respect to the magnetic flux density for effective action in the vibration direction of the acoustic diaphragm, to bring about an excellent action to favorably maintain the quality of sound generated in a speaker and headphone, etc., and of electric signals converted from sound in a microphone, etc., and in particular to achieve an ideal entire-surface drive type flat speaker having a low distortion ratio.

(1) However, where a single magnet plate the entirety of which is composed so as to be uniformly divided into seven pieces in the radius direction and to have 486 small magnets concentrically disposed is used as a magnet plate of optimum magnetization angle (Refer to FIG. 4 of Japanese Patent No. 3612319), if Sr-ferrite (Strontium ferrite) is adopted as the material of the magnets, the respective small magnets may be fixed by winding a PP tape, etc., on each of the respective rows that compose the magnet plate since the magnetic force generated in the respective small magnets is weak. However, since the magnetic flux density is not able to be increased with the Sr-ferrite, the conversion performance (hereinafter called "performance") to sound energy is remarkably low, wherein Q (resonance sharpness) becomes too high, and there is a problem that the product has less versatility.

(2) Therefore, where a neodymium-ferrum-boron-based material (hereinafter called "neodymium") that has high performance as the material of magnet is adopted in order to increase the magnetic flux density, the magnetic force operating on respective small magnets that compose a magnet plate will be increased by approximately ten times. Therefore, it has been found that it is difficult to fix the small magnets with PP tape or an adhesive agent, etc., in production of a magnet plate because of its strong magnetic force. In particular, it is difficult to fix magnetic force components parallel to the center axis of the acoustic diaphragm and toward the side where the acoustic diaphragm is installed, wherein if an attempt is made to fix the respective small magnets with the frame intervening in the direction along which the magnetic force operates, a frame will intervene between the acoustic diaphragm and the magnet plate. As a result, since the frame hinders forward and backward vibrations of the acoustic diaphragm, the adoption thereof becomes impossible.

(3) Further, if another magnet plate is added and installed at the front of the acoustic diaphragm and a repulsion force therebetween is utilized, no frame is required to intervene between the acoustic diaphragm and the magnet plate since the magnetic force is oriented in the direction opposite to the acoustic diaphragm. However, the magnet plate installed at the front of the acoustic diaphragm greatly influences the acoustic characteristics, wherein there arises another problem that use for high fidelity becomes difficult particularly in a mid frequency range or higher frequency range. In addition, there is still another problem that since the magnet plates are disassembled if they are handled one by one, it becomes remarkably complicated to design and assemble the same, and the mass productivity is inferior.

(4) Furthermore, since the direction of the magnetic force operating on the respective small magnets greatly changes based on the situation of the surrounding magnets, the direction of the magnetic force greatly changes in the process of assembling the entirety, wherein it becomes necessary to provide means for provisionally fixing the small magnets in the assembling process. In view of such situations, if means for securely fixing the small magnets independently is adopted, the area of the magnet portion is narrowed, wherein there arises still another problem that the use efficiency of the magnetic flux is remarkably worsened, it becomes difficult to process the magnets and the frame, the number of production processes is increased and complicated, and the productivity thereof is inferior.

(5) In comparison with the magnet plate of optimum magnetization angle, it is sufficient that the magnet plate magnetized in the radius direction may be composed so that trapezoidal magnets being small magnets are prepared, a plurality of the magnets are arranged in the circumferential direction so as for the upper bottom side thereof to be oriented to the center side of the magnet plate and for the lower bottom side thereof to be oriented to the outer circumference side of the magnet plate, and the center side and the outer circumference side of the entirety of the magnet plate are inserted between the frames. Therefore, it becomes remarkably simple to produce the magnet plate, and productivity is made excellent. However, the magnet plate magnetized in the radius direction is featured in that it has less utilization efficiency, the magnetic flux for effective action is remarkably widely dispersed, and the magnetic flux density for effective action is lowered. Accordingly, where the acoustic diaphragm is used in an area of general width that is not wide, the utilization efficiency of the magnetic flux is further lowered. In particular, in a speaker in which the area of the diaphragm is not able to be widened such as those for a mid frequency range and a high frequency range, since the magnetic flux is concentrated in a narrow area of the diaphragm and the magnetic flux density is required to be increased, such a magnet plate is not able to be used as it is, wherein there is still another problem that the versatility and practicability are inferior.

In the viewpoints described above, it is strongly demanded that an electroacoustic transducer capable of improving the utilization efficiency and performance, which is simple in structure and has excellent versatility and mass productivity is developed.

It is therefore an object of the present invention to provide an electroacoustic transducer, capable of meeting the above-described requirements, which does not require any special shape and processing as a magnet, does not require the magnetization direction to be minutely set, and may improve the performance by further remarkably increasing the magnetic flux density for effective action than a magnet plate magnetized in the radius direction in addition to the production process being simple as in a magnet plate magnetized in the radius direction, for a speaker, a headphone, an earphone, etc., which may efficiently carry out conversion from electric signals to sound at low distortion and for a microphone, a acoustic wave sensor, etc., which may efficiently carry out conversion from sound to electric signals at low distortion in a state where the distribution of high magnetic flux densities for effective action is set for an electric conductor of an acoustic diaphragm.

Means for Solving the Object

An electroacoustic transducer according to the present invention has the following configurations in order to solve the above-described object.

An electroacoustic transducer according to a first aspect of the present invention is an electroacoustic transducer including a magnet plate the entirety of which is formed to be disk-shaped or ring-shaped, and a disk-shaped or ring-shaped acoustic diaphragm provided with a planar coil disposed parallel to the magnet plate and formed by spirally winding an electric conductor; wherein the electroacoustic transducer is provided with at least any one of a center area magnet magnetized so that a component parallel to the center axis of the acoustic diaphragm is turned into the forward direction of the acoustic diaphragm at the position that becomes the center side of the base area magnet and an outer circumference area magnet magnetized so that a component parallel to the center axis of the acoustic diaphragm is turned into the backward direction of the acoustic diaphragm at the position that becomes the outer circumference side of the base area magnet, in addition to a base area magnet magnetized so that a component parallel to the vibration plane of the acoustic diaphragm is turned into the radius direction toward the center of the acoustic diaphragm with respect to the magnetization direction of respective partial areas of a magnet plate.

With such a configuration, the following actions are brought about.

(1) Respective partial areas may be set so that the extent of contribution of magnetic flux for effective action to electric conductors of an acoustic diaphragm may be increased by adjusting the magnetization direction at the respective partial areas by means of a magnet plate in which a center area magnet is placed at the center side of the base area magnet and an outer circumference area magnet is placed at the outer circumference side thereof. Based on a magnet plate (hereinafter called a "magnet plate magnetized in three directions") in which respective partial areas are set to such an effective magnetization angle, it is possible to effectively generate magnetic fluxes in the radius direction along the vibration plane of the acoustic diaphragm, wherein an area having a high magnetic flux density for effective action may be secured at a wide range. In comparison with the magnet plate magnetized in the radius direction, the magnetic flux density for effective action is increased, wherein the performance of a speaker, which is insufficient, may be raised to a practicable level, and the value of Q (resonance sharpness) of a low frequency range speaker, which became too high, may be lowered to a practicable level.

(2) In comparison with the magnet plate magnetized in the radius direction, although the inner circumference side area and the outer circumference side area are reduced and are narrowed in an area, where the magnetic flux density for effective action is high, in a magnet plate magnetized in three directions, the magnetic flux density for effective action is increased as a whole. That is, since the entire magnetic flux density for effective action may be increased equivalent to the reduced magnetic flux for effective action at the inner circumference side area and at the outer circumference side area, it is possible to distribute the magnetic flux for effective action to a useful area. Thus, although the magnet plate magnetized in three directions distributes the magnetic flux for effective action in the outer circumference side area and the inner circumference side area, which is not used in an acoustic diaphragm, to a useful area that is used in the acoustic diaphragm, and may increase the magnetic flux density for effective action, the magnetic flux density for effective action may be intensively increased by further narrowing the area to be used.

(3) By means of a magnet plate in which the base area magnet is combined with a center area magnet at the center side thereof, and a magnet plate in which the base area magnet is combined with an outer circumference area magnet at the outer circumference side thereof, respective partial areas may be set so that the extent of contribution of magnetic flux for effective action to electric conductors of an acoustic diaphragm may be increased by adjusting the magnetization direction at the respective partial areas. By a double-magnetized magnet plate (hereinafter called a "magnet plate magnetized in two directions") in which the respective partial areas are subjected to such effective magnetization angles, it is possible to effectively generate magnetic fluxes in the radius direction along the vibration plane of the acoustic diaphragm, wherein an area having a high magnetic flux density for effective action may be secured at a wide range.

A magnet plate magnetized in two directions may narrow the area of a magnet with respect to an area of a high magnetic flux density for effective action in comparison with the magnet plate magnetized in three directions. Therefore, when sound generated from the rear side of the acoustic diaphragm is discharged to the back of the electroacoustic transducer, hindrance due to the magnet may be reduced, wherein influence on vibrations of the acoustic diaphragm may be reduced, and it is possible to prevent the acoustic characteristics from being worsened.

(4) In a magnet plate magnetized in two directions, in which the base area magnet is combined with the center area magnet at the center side thereof, the magnet plate in which the respective partial areas are subjected to effective magnetization angles causes the inner circumference side area to be reduced and narrowed in an area at which magnetic flux densities for effective action are high, in comparison with the magnet plate magnetized in the radius direction. However, the magnetic flux densities for effective action becomes high as a whole. That is, the magnetic flux densities for effective action may be increased as a whole, equivalent to the magnetic flux for effective action in the reduced inner circumference side area.

In comparison with a magnet plate magnetized in three directions, although the magnetic flux densities for effective action may be decreased as a whole, an area at which the magnetic flux density for effective action is high is widened to the outer circumference side since no outer circumference area magnet is adopted, the optimum structure is brought about when the diameter of an acoustic diaphragm is designed to be large as in a low frequency range speaker.

(5) In a magnet plate magnetized in two directions, in which the base area magnet is combined with the outer circumference area magnet at the outer circumference side thereof, the magnet plate in which the respective partial areas are subjected to effective magnetization angles causes the outer circumference side area to be reduced and narrowed in an area at which magnetic flux densities for effective action are high, in comparison with the magnet plate magnetized in the radius direction. However, the magnetic flux densities for effective action become high as a whole. That is, the magnetic flux densities for effective action may be increased as a whole, equivalent to the magnetic flux for effective action in the reduced outer circumference side area.

The smaller the outer diameter of the diaphragm becomes, or the smaller the inner diameter is made where the diaphragm is ring-shaped as in the present invention, the more favorable the directivity characteristics becomes. Since a magnet plate in which the base area magnet is combined with the outer circumference area magnet at the outer circumference side thereof as shown above may form a distribution of high magnetic flux densities for effective action at an area of the acoustic diaphragm the outer diameter and the inner diameter of which are made small, it is possible to manufacture a mid frequency range speaker and a high frequency range speaker, which have favorable directivity characteristics and performance.

(6) Where an electroacoustic transducer according to the present invention, which further has an outer circumference area magnet at the center part, is coaxially disposed in the electroacoustic transducer according to the present invention, in which a magnet plate having a center area magnet is used, the center area magnet may be concurrently used as an outer circumference area magnet in an electroacoustic transducer at the center part. Also, in this case, since an area that does not require high magnetic flux densities for effective action at the inner circumference side of the acoustic diaphragm is widened, it is distributed to the area, in which a magnetic flux for effective action in the inner circumference side area is used, by the center area magnet to cause the magnetic flux densities for effective action to be increased. Thus, where a coaxial type speaker is brought about, the features of the center area magnet may be utilized to the maximum.

Here, a magnet plate magnetized in three directions is such that the center area magnet is installed at the center side of the base area magnet and the outer circumference area magnet is installed at the outer circumference side thereof. Also, a magnet plate magnetized in two directions is such that only the center area magnet is installed at the center side of the base area magnet or only the outer circumference area magnet is installed at the outer circumference side of the base area magnet.

An effective magnetization angle at which the extent of contribution of magnetic flux for effective action to an electric conductor of an acoustic diaphragm is increased in the respective partial areas is separated into two cases, depending on the magnetization direction of the base area magnet. Although the magnetization direction of the base area magnet is such that a component parallel to the vibration plane of the acoustic diaphragm is magnetized in the radius direction of the acoustic diaphragm, there are two cases, one of which is the radius direction toward the center side, the other of which is the radius direction toward the outer circumference side.

Where the component in the magnetization direction of the base area magnet is in the radius direction toward the center side, the magnetization direction of the center area magnet is such that the component parallel to the center axis of the acoustic diaphragm is turned into the forward direction (hereinafter, called the "forward direction of the center axis") of the acoustic diaphragm, and the magnetization direction of the outer circumference area magnet is such that the component parallel to the center axis of the acoustic diaphragm is turned into the backward direction (hereinafter, called the "backward direction of the center axis") of the acoustic diaphragm. In addition, where the component in the magnetization direction of the base area magnet is turned into the radius direction toward the outer circumference side, the magnetization direction of the center area magnet is such that the component parallel to the center axis of the acoustic diaphragm is turned into the backward direction of the center axis, and the magnetization direction of the outer circumference area magnet is such that the component parallel to the center axis of the acoustic diaphragm is turned into the forward direction of the center axis.

The magnetization angle by which the extent of contribution of magnetic flux for effective action to an electric conductor of the acoustic diaphragm is maximized for three types of partial areas changes by the gap between the acoustic diaphragm and the magnet plate, the area of the electric conductor portion of the acoustic diaphragm and the ratio occupied by the respective partial areas of the magnet plate. Therefore, the magnetization angles of the respective partial areas may be appropriately determined while taking the whole distribution condition of magnetic flux densities for effective action and the utilization efficiency of the magnetic fluxes into consideration based on the above-described conditions.

Further, where the radius direction toward the center of the acoustic diaphragm is 0 degrees and the forward direction of the acoustic diaphragm is a positive direction, it is favorable that the magnetization angle of the base area magnet is in a range of −30 degrees or more but 70 degrees or less.

The distribution of the magnetic fluxes for effective action to the electric conductor of the acoustic diaphragm, which is formed by the base area magnet, changes by the gap between the acoustic diaphragm and the base area magnet, the area of the electric conductor portion of the acoustic diaphragm and the position and size of the base area magnet. There are many cases where the base area magnet is installed in a wide area at the back of the electric conductor portion of the acoustic diaphragm. And, a description is given of the distribution of magnetic flux densities for effective action where such an area is adopted.

When the magnetization angle of the base area magnet is set to approximately 10 degrees, an area at which magnetic flux densities for effective action are high is located almost at an intermediate part between the inner circumference side and the outer circumference side of the acoustic diaphragm. Although the area at which magnetic flux densities for effective action are high is moved to the inner circumference side of the acoustic diaphragm in line with a decrease in the magnetization angle, the magnetic flux densities for effective action are lowered as a whole if the magnetization angle is made lower than −30 degrees, wherein such a tendency appears by which the utilization efficiency of magnetic flux is further lowered. Further, although the area at which magnetic flux densities for effective action are high is moved to the outer circumference side of the acoustic diaphragm in line with an increase in the magnetization angle of the base area magnet exceeding 10 degrees, the magnetic flux densities for effective action are lowered as a whole if exceeding 70 degrees, wherein such a tendency appears by which the utilization efficiency of magnetic flux is lowered.

If the value obtained by adding up the magnetic flux for effective action at an electric conductor of the acoustic diaphragm in terms of the area of the electric conductor is compared with a case where the prior art magnetization angle is 90 degrees (for example, Patent Document 2), the value reaches 2.5 times where the magnetization angles of the respective partial areas are optimized in a magnet plate magnetized in two directions, and reaches approximately 1.7 times where the magnetization angle of the base area magnet is set to 70 degrees. Thus, by optimizing the magnetization angle of the base area magnet, the utilization efficiency of magnetic fluxes may be remarkably increased.

In addition, in comparison with a case where the prior art magnetization angle is fixed to be 90 degrees, since the distribution condition maybe adjusted by varying the magnetization angle with respect to the distribution of magnetic flux densities for effective action at respective positions of the acoustic diaphragm, it becomes easy to make the distribution uniform, wherein a uniform drive force may be obtained at the entire surface of the diaphragm.

There are two cases for installing the magnet plate, one of which is a case where a single magnet plate is arranged at the back of the acoustic diaphragm, and the other of which is a case where two magnet plates are arranged both at the front and back of the acoustic diaphragm. Such a structure in which two magnet plates are arranged both at the front and back of the acoustic diaphragm may reduce the volume of magnets used since the magnetic flux densities for effective action may be efficiently increased. Furthermore, since the difference in the magnetic flux densities for effective action is reduced with respect to vibrations in the forward and backward directions of the acoustic diaphragm, the structure is featured in that distortion resulting from the difference may be reduced. Therefore, where influence upon the acoustic characteristics may be disregarded even if a magnet plate is arranged at the front of the acoustic diaphragm, it is better that the structure of arranging two magnet plates is adopted.

Also, even where one magnet plate is installed at the back of the acoustic diaphragm, if any one of the center area magnet and the outer circumference area magnet or both is (or are) installed at the front of the acoustic diaphragm, the magnet plate at the front of the acoustic diaphragm reduces influence on the acoustic characteristics, and may increase the magnetic flux densities for effective action.

In addition, although, where magnets are disposed at the front of the acoustic diaphragm, the magnets are disposed so that the magnetization directions of partial areas are generally opposed to each other with respect to the vibration plane of the acoustic diaphragm, there may be cases where the magnets are not symmetrical to each other in order to improve the utilization efficiency of magnetic fluxes and to improve the uniformity of magnetic flux distributions in the vicinity of the acoustic diaphragm.

Although there are many cases where the center area magnet is composed of a single ring-shaped or columnar-shaped magnet because it is at the center part of the magnet plate and the area thereof is small, a plurality of small magnets are combined and used where the magnetization direction is determined to be a direction along which magnetization is difficult and where a gap is provided in the center area magnet and is used for a sound passage port. If the base area magnet is composed of a single magnet since it has many radius-direction components for the magnetization direction, it is difficult to magnetize the base area magnet. In addition, since there are many cases where a gap provided in the base area magnet is used as a sound passage port, there are many cases where the base area magnet is composed of a plurality of small magnets separated from each other. Although there are many cases where the outer circumference area magnet is composed of a single ring-shaped magnet when an acoustic diaphragm the diameter of which is small is adopted, it is preferable that the outer circumference area magnet is combined with small magnets divided because the area becomes considerably large when an acoustic diaphragm the diameter of which is large is adopted.

Permanent magnets such as a neodymium or Sm—Co-based rare earth magnet, a ferrite magnet, and an alnico magnet, etc., may be adopted as the material of such a magnet plate.

As the acoustic diaphragm, a planar coil in which insulated electric conductors formed of aluminum, copper, silver, gold, etc., are spirally wound and the electric conductors are adhered to each other by a silicone resin or synthetic resin-based adhesive agent such as epoxy, cyanoacrylate-based resins may be used, or a multi-layered planar coil the strength of which is increased by adhering a plurality of planar coils to each other may be used.

Also, such a type may be used in which circuits are formed as a spiral pattern by using electric conductors of aluminum, copper, silver, gold, etc., by means of vapor deposition means and etching means, etc., on a plane of thin substrate material made of synthetic resin such as polyimide, polyethylene, polycarbonate, ceramic, synthetic fibers, wooden fibers, or a composite material thereof, all of which are non-magnetic materials.

It is necessary that the diameter of the diaphragm is decreased to prevent the directivity characteristics from being worsened in line with the band reproduced by a speaker becoming closer and closer to a high frequency band. Also, a diaphragm the diameter of which is small is used in a microphone, etc. Although it is necessary to increase the magnetic flux densities for effective action since the performance and sensitivity are lowered if the area of the diaphragm is reduced, the magnetic flux for effective action is concentrated in a magnet plate magnetized in three directions in regard to a diaphragm the diameter of which is small, thereby increasing the magnetic flux densities for effective action, wherein the performance and sensitivity may be effectively improved.

In a magnet plate magnetized in three directions and a magnet plate having a center area magnet and magnetized in two directions, a magnetic force oriented to the opposite side (backward) of the acoustic diaphragm operates onto the center side of the base area magnet by means of the center area magnet. In addition, in a magnet plate magnetized in three directions and a magnet plate having an outer circumference area magnet and magnetized in two directions, a magnetic force oriented to the opposite side (backward) of the acoustic diaphragm operates onto the outer circumference side of the base area magnet by means of the outer circumference area magnet.

Thus, where a strong magnet such as a neodymium magnet is used in the magnet plate magnetized in three directions, the base area magnet may be fixed only by catching it by a frame installed at the back of the electroacoustic transducer. Therefore, if a magnet that brings a strong magnetic force such as a neodymium magnet is adopted, the center area magnet and the outer circumference area magnet are fixed at the frame installed at the back of the electroacoustic transducer by being inserted between the frames, etc., and a magnet plate may be composed only by setting the base area magnet between the center area magnet and the outer circumference area magnet.

Further, in a magnet plate magnetized in two directions as well, it is possible to fix the magnet plate only by catching the center side of the base area magnet if the magnet plate includes a center area magnet, and the outer circumference side of the base area magnet if the magnet plate includes an outer circumference area magnet, by means of the frame installed at the back of the electroacoustic transducer.

Since the magnetic flux densities for effective action may be dramatically increased than in the magnet plate magnetized in the radius direction by adopting the center area magnet and the outer circumference area magnet, ease in production of the magnet plate magnetized in the radius direction may succeed as it is. Accordingly, while maintaining the magnetic flux densities for effective action, which are close to the magnet plate of optimum magnetization angle, no problem exists in the production of a magnet plate of optimum magnetization angle even in a case where a high performance magnet is used, wherein it becomes remarkably easy to produce a magnet plate for a speaker, a headphone, a microphone, etc.

An electroacoustic transducer according to a second aspect of the present invention is an electroacoustic transducer including a magnet plate the entirety of which is formed to be disk-shaped or ring-shaped, and a disk-shaped or ring-shaped acoustic diaphragm provided with a planar coil disposed parallel to the magnet plate and formed by spirally winding an electric conductor; wherein the electroacoustic transducer is provided with at least any one of a center area magnet magnetized so that a component parallel to the center axis of the acoustic diaphragm is turned into the backward direction of the acoustic diaphragm at the position that becomes the center side of the base area magnet and an outer circumference area magnet magnetized so that a component parallel to the center axis of the acoustic diaphragm is turned into the forward direction of the acoustic diaphragm at the position that becomes the outer circumference side of the base area magnet, in addition to a base area magnet magnetized so that a component parallel to the vibration plane of the acoustic diaphragm is turned into the radius direction toward the outer circumference of the acoustic diaphragm with respect to the magnetization direction of respective partial areas of the magnet plate.

With this configuration, actions similar to those of the first aspect may be brought about.

Here, the electroacoustic transducer according to the second aspect is different from that according to the first aspect only in that the magnetization directions of respective partial areas of a magnet plate magnetized in three directions and a magnet plate magnetized in two directions are inverted by 180 degrees. All the others are identical to the description given with respect to the first aspect. Therefore, the description is omitted.

The invention according to a third aspect is the electroacoustic transducer according to the first aspect or the second aspect, which has a configuration that includes a frame for fixing at least any one of the center area magnet and the outer circumference area magnet at the side that is opposite to the side where the acoustic diaphragm is installed at the magnet plate, wherein the base area magnet is fixed at the frame by a magnetic force that the center area magnet or the outer circumference area magnet presses the base area magnet to the frame side.

With the configuration, the following actions may be brought about in addition to the first aspect or the second aspect.

(1) In the magnet plate magnetized in three directions and the magnet plate magnetized in two directions, a magnetic force that presses the center side of the base area magnet to the frame at the back of an electroacoustic transducer operates by the center area magnet. Also a magnetic force that presses the outer circumference side of the base area magnet to the frame at the back of an electroacoustic transducer operates by the outer circumference area magnet. If a neodymium magnet, etc., having high performance as a magnet is used, the magnetic forces become very strong, wherein the base area magnet is fixed.

By utilizing such magnetic forces, a new fixing means for fixing the base area magnet, such as a special frame, is not required. Therefore, a restricted magnet area may be effectively utilized, and the utilization efficiency of magnetic fluxes may be improved. Also, since it is not necessary to form the magnets in a particular shape for the fixing means, the processing may be simplified, and the manufacturing processes may be remarkably simplified.

(2) Generally, the acoustic diaphragm is mounted by fixing the edge parts at the center side and the outer circumference side of the magnet plate. Although the center area magnet jumps forward from the magnet plate if the bolts for fixing the center area magnet are removed after the magnet plate is assembled, the center area magnet stops halfway without completely jumping out. Since the center area magnet does not completely jump out, the center side of the acoustic diaphragm may be simultaneously mounted by setting the acoustic diaphragm as it is, and tightening the bolts, by which the center area magnet is mounted, altogether. Since such a manner may be adopted in a restricted area of the center part, the manner is very favorable in view of the acoustic performance and the manufacturing processes.

Here, although resin such as acrylic resin may be favorably used as the frame where a magnet such as a ferrite magnet in which influence based on the magnetic force is weak is used, the frame may be cracked by a large magnetic force in a neodymium magnet, etc., wherein a non-magnetic metal such as aluminum, copper, etc., is preferably used. In addition, where the magnetic force operates in a direction along which the magnet is removed from the frame, as the means for fixing a magnet on the frame, it becomes considerably difficult to fix by an adhesive agent, etc. Therefore, it becomes easy to securely fix the magnet by being inserted between the frames or between the frame and bolts.

Where assembling a magnet plate magnetized in three directions, the center area magnet and the outer circumference area magnet are first fixed on the frame at the back of the electroacoustic transducer. The work may be easily carried out in a state where the influence based on the magnetic force is weak since the center area magnet and the outer circumference area magnet are apart from each other. Next, if the base area magnet is brought to the position that comes to the front of the magnet plate between the center area magnet and the outer circumference area magnet, the magnet plate may be fixed at a predetermined position since the base area magnet is pulled at the back of the magnet plate by a magnetic force, the base area magnet is caught by the frame at the back of the electroacoustic transducer. Where the base area magnet is composed of a plurality of small magnets, the magnet plate may be completed by repeating the work by the number of the small magnets.

Thus, the respective processes for manufacturing the magnet plate are remarkably simple, wherein the point to which attention is paid is only to gently set and to prevent it from being cracked since the magnetic force operating on the base area magnet is strong in a case of a neodymium magnet, etc. Further, in regard to design, it is not necessary to take into consideration the structure for the fixing means and influences resulting from the magnetic force while assembling, and the mass productivity is made excellent.

The invention according to a fourth aspect is an electroacoustic transducer according to the first aspect or the second aspect, which has a configuration that includes at least any one of the front center area magnet disposed at a position symmetrical to the center area magnet with the acoustic diaphragm inserted therebetween and magnetized in the direction plane-symmetrical to the magnetization direction of the center area magnet with respect to the vibration plane of the acoustic diaphragm and the front outer circumference area magnet disposed at a position symmetrical to the outer circumference area magnet with the acoustic diaphragm inserted therebetween and magnetized in the direction plane-symmetrical to the magnetization direction of the outer circumference area magnet with respect to the vibration plane of the acoustic diaphragm.

With the configuration, the following action may be brought about in addition to those obtained in the first aspect or the second aspect.

(1) By disposing the front center area magnet and the front outer circumference area magnet, which are magnetized in the direction plane-symmetrical so as to be opposed to the center area magnet and the outer circumference area magnet with the acoustic diaphragm inserted therebetween, the magnetic flux densities for effective action on the acoustic diaphragm may be further increased. Further, since the portions being the front center side and the front outer circumference side of the acoustic diaphragm, which hardly influence sound, may be utilized, the magnetic flux densities for effective action may be increased without damaging the acoustic characteristics, wherein it becomes easy to improve the performance.

The front center area magnet and the front outer circumference area magnet, which are at the front of the acoustic diaphragm, may contribute to improve the acoustic characteristics by varying the shapes thereof. For example, the front center area magnet may be used as a diffuser, which may improve the directivity characteristics, by devising the shape thereof, and the front outer circumference area magnet may be used as a horn.

The invention according to a fifth aspect is an electroacoustic transducer according to the fourth aspect, which has a configuration that includes a front base area magnet disposed at a position symmetrical to the base area magnet with the acoustic diaphragm inserted therebetween and magnetized in the direction plane-symmetrical to the magnetization direction of the base area magnet with respect to the vibration plane of the acoustic diaphragm.

With the configuration, the following actions may be brought about in addition to those obtained in the fourth aspect of the invention.

(1) By installing the front base area magnet magnetized in the direction plane-symmetrical so as be opposed to the base area magnet at the front side of the acoustic diaphragm, the magnet volume may be increased in a position close to the acoustic diaphragm, and the magnetic flux densities for effective action may be efficiently increased.

(2) By installing the front base area magnet at the front of the acoustic diaphragm in addition to the front center area magnet and the front outer circumference area magnet, which are magnetized in the direction plane-symmetrical to the rear magnet plate other than the rear magnet plate of the acoustic diaphragm, the magnetic flux densities for effective action at respective positions of the vibrating acoustic diaphragm may be made symmetrical to the vibration direction with respect to the installation position of the acoustic diaphragm. Therefore, it is possible to prevent distortion, which is produced due to a difference in fluctuations of the magnetic flux densities for effective action in the vibration direction of the acoustic diaphragm.

Herein, the front base area magnet may be disposed at the front of the acoustic diaphragm as a front magnet plate having at least one of the front center area magnet and the front outer circumference area magnet.

At this time, the magnetization direction at the respective partial areas of the magnet plate disposed at the back of the acoustic diaphragm and the magnetization direction at the respective partial areas of the front magnet plate disposed at the front of the acoustic diaphragm are opposed to each other (are plane-symmetrical to each other with respect to the vibration plane of the acoustic diaphragm). Therefore, only by disposing the front frame, which fixes the front center area magnet or the front outer circumference area magnet, at the front (the side opposite to the side where the acoustic diaphragm is installed) of the front magnet plate, the front base area magnet is fixed at the front frame by a magnetic force that the front center area magnet or the front outer circumference area magnet presses the front base area magnet to the front frame side.

The invention according to a sixth aspect is an electroacoustic transducer according to the first aspect or the second aspect, wherein at least any one of the base area magnet, the outer circumference area magnet and the center area magnet of the magnet plate is provided with sound passage ports through which sound generated outside or inside is caused to pass.

With the configuration, the following action may be brought about in addition to those obtained in the first aspect or the second aspect of the invention.

(1) Since a plurality of sound passage ports that pass sound through the magnet plate are formed, a speaker and a headphone, etc., discharge sound, which is generated across the entire surface of the acoustic diaphragm, without causing interference with each other, and electric signals having less distortion may be obtained by a microphone, etc., which reduces interference of sound received from the periphery.

Here, the sound passage port is an opening portion formed in the respective partial areas of a magnet plate. As the method for providing the sound passage ports, there is a method for forming opening portions directly in the magnet, and a method for utilizing gaps provided between the magnets adjacent to each other. Although the sound passage port is formed so that the center axis of the port is located at the direction perpendicular to the vibration plane of the acoustic diaphragm, the acoustic characteristics are improved and the sound collection performance is improved by tilting the center axis, or providing the tilting portions that enlarges or reduces the diameter of the inner wall of the port with respect to the sound advancing direction.

The sound passage ports may be provided in the respective partial areas of the base area magnet, the outer circumference area magnet and the center area magnet. However, since the distribution state of the magnetic flux densities for effective action and the utilization efficiency of magnetic fluxes are adversely influenced, the position and the ratio for the magnets are determined while understanding these situations.

The invention according to a seventh aspect is an electroacoustic transducer in which a plurality of electroacoustic transducers according to the first aspect or the second aspect are concentrically disposed with the sizes thereof made different from each other.

With the configuration, the following actions may be brought about in addition to those obtained in the first aspect or the second aspect.

(1) Since independent electroacoustic transducers having sizes of diaphragms and acoustic characteristics, which are different from each other, are concentrically (coaxially) composed, and the entirety thereof may be a composite-type electroacoustic transducer, these transducers are integrally installed appropriately arranged according to application conditions such as the sound radiation area, etc., an electroacoustic transducer that is excellent in the acoustic characteristics may be composed. For example, by combining electroacoustic transducers having different reproduction frequency ranges such as for a high frequency range, amid frequency range, and a low frequency range, etc., it is possible to easily compose a composite-type electroacoustic transducer having excellent frequency characteristics and directivity characteristics.

(2) Since electroacoustic transducers having different acoustic characteristics from each other are coaxially disposed to compose a composite-type transducer, an electroacoustic transducer that is excellent in phase characteristics may be brought about.

EFFECT OF THE INVENTION

As described above, according to an electroacoustic transducer of the present invention, the following advantageous effects may be brought about.

According to the first aspect of the invention, the following effects may be brought about.

(1) By using a magnet plate magnetized in three directions and a magnet plate magnetized in two directions, magnetic fluxes in the radius direction along the vibration plane of an acoustic diaphragm may be effectively generated, it is possible to secure an area having high magnetic flux densities for effective action at a wide range. Accordingly, the magnetic flux densities for effective action are made higher than in a magnet plate magnetized in the radius direction, wherein it is possible to improve the performance of a speaker, which was insufficient, and at the same time, the value of Q (Resonance sharpness) of a low frequency range speaker, which becomes too high, may be lowered, wherein it is possible to provide an electroacoustic transducer that is excellent in practicability.

(2) A magnet plate magnetized in three directions distributes magnetic fluxes for effective action of the outer circumference side area and the inner circumference side area, which are not used in an acoustic diaphragm, to an effective area used in an acoustic diaphragm, and may increase the magnetic flux densities for effective action as the entirety. In addition, by narrowing the area used, the magnetic flux densities for effective action may be further increased intensively, wherein it is possible to provide an electroacoustic transducer that may effectively increase the performance and sensitivity and is excellent in efficiency.

(3) A magnet plate magnetized in two directions may narrow the area of magnets with respect to an area of high magnetic flux densities for effective action in comparison with the magnet plate magnetized in three directions. Therefore, when sound generated from the rear side of an acoustic diaphragm is discharged to the back of an electroacoustic transducer, hindrance based on magnets may be reduced, wherein it is possible to reduce adverse influence on vibrations of the acoustic diaphragm and to prevent the acoustic characteristics from being worsened. Therefore, it is possible to provide an electroacoustic transducer having excellent reliability.

(4) A magnet plate magnetized in two directions, in which a base area magnet and a center area magnet are combined, the magnetic fluxes for effective action in the inner circumference side area is concentrated in a specified area and may increase the magnetic flux densities for effective action as the entirety in comparison with the magnet plate magnetized in the radius direction. Also, the magnet plate may widen the area of high magnetic flux densities for effective action to the outer circumference side in comparison with a magnet plate magnetized in three directions, wherein it is possible to provide an optimum electroacoustic transducer where the diameter of the acoustic diaphragm is designed to be large as in a low frequency range speaker.

(5) A magnet plate magnetized in two directions, in which a base area magnet and an outer circumference area magnet are combined, the magnetic fluxes for effective action in the outer circumference side area is concentrated in a specified area and may increase the magnetic flux densities for effective action as the entirety in comparison with the magnet plate magnetized in the radius direction. Also, the outer diameter and the inner diameter of a ring-shaped acoustic diaphragm may be reduced, wherein it is possible to provide an electroacoustic transducer that is favorable as amid frequency range speaker and a high frequency range speaker having favorable directivity characteristics and performance.

(6) Where, in an electroacoustic transducer according to the present invention in which a magnet plate having a center area magnet is used, an electroacoustic transducer according to the present invention, which has an outer circumference area magnet further at the center part is coaxially disposed, the center area magnet may be concurrently used as an outer circumference area magnet in the electroacoustic transducer in the center part. Therefore, the volume of magnets used may be reduced, and the restricted magnet area may be effectively utilized. Also, since the magnetic flux densities for effective action may be increased by the center area magnet distributing the magnetic flux for effective action of the inner circumference side area, which are not used in the acoustic diaphragm, to the area to be used, wherein it is possible to provide an electroacoustic transducer having excellent efficiency, which may utilize the features of the center area magnet to the maximum.

According to the second aspect of the invention, effects similar to those of the first aspect may be brought about.

According to the third aspect of the invention, the following effects may be brought about in addition to those of the first aspect or the second aspect.

(1) In the magnet plate magnetized in three directions and the magnet plate magnetized in two directions, a magnetic force that presses the center side and the outer circumference side of the base area magnet to the frame at the back of an electroacoustic transducer operates by each of the center area magnet and the outer circumference area magnet. Therefore, particularly by using a neodymium magnet, etc., which has high performance as a magnet, the base area magnet may be fixed by utilizing a remarkably strong magnetic force. Accordingly, since a new fixing means is not required, an electroacoustic transducer that is excellent in workability and mass productivity may be provided.

(2) Since a special frame to fix the respective magnets is not required, a restricted magnet area may be effectively utilized, wherein the utilization efficiency of a magnetic flux may be increased. Also, since it is not necessary to process the shape of the magnets into any special shape for the fixing means, an electroacoustic transducer that is simple in a manufacturing process and excellent in mass productivity may be provided.

(3) Since the center side of the acoustic diaphragm may be simultaneously attached by using bolts for attaching the center area magnet, restricted space of the center part may be effectively utilized. Further, an electroacoustic transducer may be provided which is simple in a manufacturing process, excellent in mass productivity, and has high quality with a simplified structure.

According to the fourth aspect of the invention, the following effect may be brought about in addition to the effects of the first aspect or the second aspect.

(1) Since the front center area magnet and the front outer circumference area magnet are disposed so as to be opposed to the center area magnet and the outer circumference area magnet with the acoustic diaphragm inserted therebetween, it is possible to increase the magnetic flux densities for effective action on the acoustic diaphragm without damaging the acoustic characteristics by utilizing the portions, which become the center side and the outer circumference side, at the front of the acoustic diaphragm, having less influence on sound. Therefore, it is possible to provide an electroacoustic transducer that may easily increase the performance.

According to the fifth aspect of the invention, the following effects may be brought about in addition to the effects of the fourth aspect.

(1) Since the front base area magnet is disposed so as to be opposed to the base area magnet with the acoustic diaphragm inserted therebetween, the magnet volume is increased at a position close to the acoustic diaphragm and the magnetic flux densities for effective action may be efficiently increased. Therefore, an electroacoustic transducer may be provided which may efficiently increase the performance with a slight magnet volume and is excellent in efficiency.

(2) The magnetic flux densities for effective action at respective positions of a vibrating acoustic diaphragm may be made symmetrical to the vibration direction with respect to the installation position of the acoustic diaphragm. Accordingly, it is possible to prevent distortion that is produced due to a difference in the level of the magnetic flux densities for effective action in the vibration direction of the acoustic diaphragm, and an electroacoustic transducer may be provided which is favorable as a low frequency range speaker that increases the amplitude of the acoustic diaphragm.

According to the sixth aspect of the invention, the following effect may be brought about in addition to those of the first aspect or the second aspect.

(1) Since a plurality of sound passage ports that pass sound through the magnet plate are formed, a speaker and a headphone, etc., discharge sound, which is generated across the entire surface of the acoustic diaphragm, without causing interference with each other, and electric signals having less distortion may be obtained by a microphone, etc., which reduces interference of sound received from the periphery. Therefore, an electroacoustic transducer that is excellent in acoustic characteristics may be provided.

According to the seventh aspect of the invention, the following effects may be brought about in addition to those of the first aspect or the second aspect.

(1) Since independent electroacoustic transducers having sizes of diaphragms and acoustic characteristics, which are different from each other, are concentrically (coaxially) composed, and the entirety thereof may be a composite-type electroacoustic transducer, these transducers are integrally installed appropriately arranged according to application conditions such as the sound radiation area, etc., an electroacoustic transducer that is excellent in the acoustic characteristics may be brought about.

(2) Since an electroacoustic transducer that has different reproduction frequency ranges such as for a high frequency range, a mid frequency range and a low frequency range may be easily and coaxially combined, a composite-type electroacoustic transducer having excellent frequency characteristics and excellent directivity characteristics may be provided.

(3) Since electroacoustic transducers having different acoustic characteristics from each other may be coaxially disposed to compose a composite-type, an electroacoustic transducer that is excellent in phase characteristics may be provided.

DESCRIPTION OF REFERENCE NUMERALS

Figure 1:
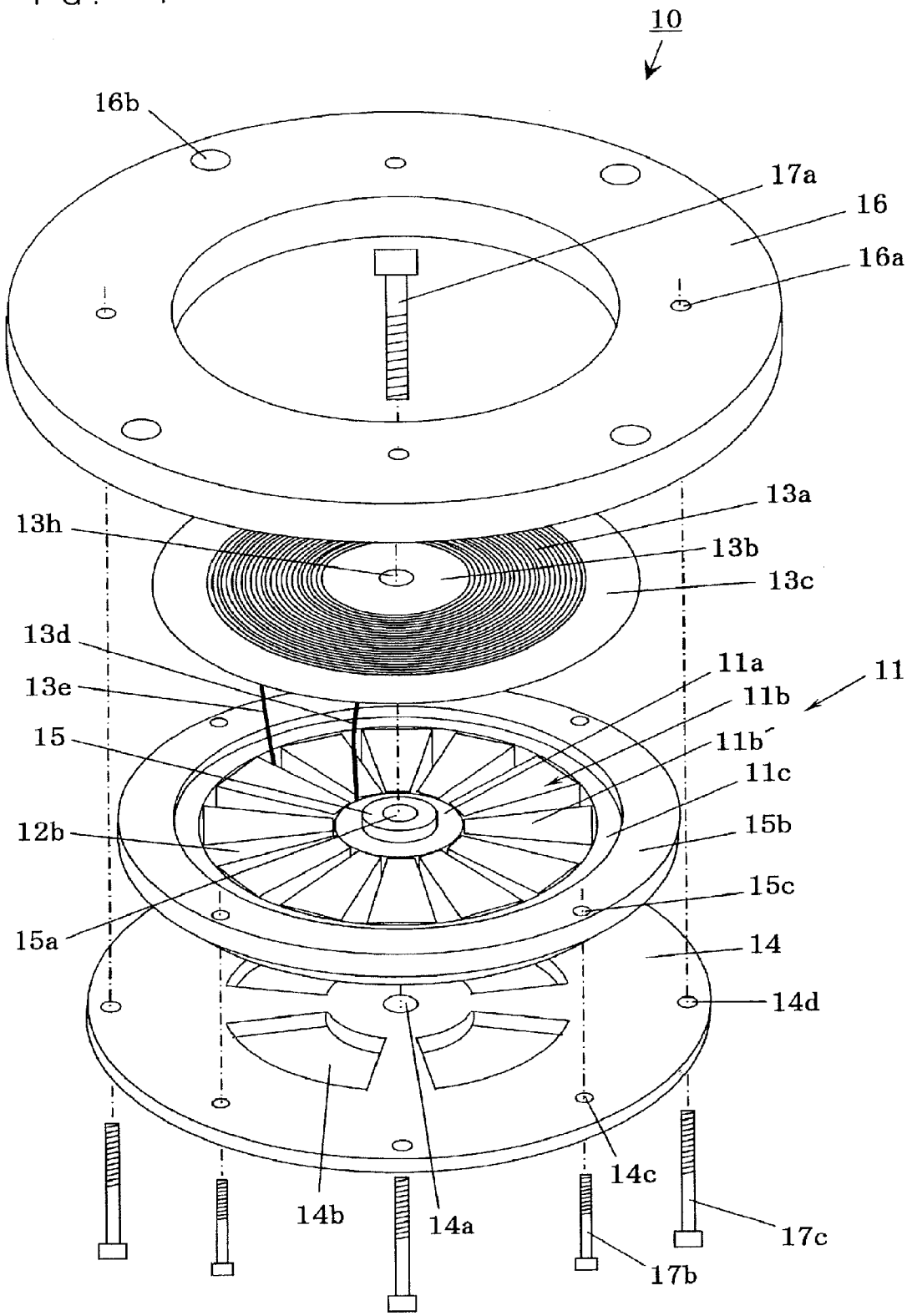
FIG. 1 is a disassembled perspective view showing an electroacoustic transducer according to Embodiment 1.

10, 20, 30, 40, 50, 60 . . . Electroacoustic transducers

11, 21, 41, 51, 61 . . . Magnet plates

11*a*, 21*a*, 41*a*, 51*a*, 61*a* . . . Center area magnets

11*b*, 21*b*, 41*b*, 51*b*, 61*b* . . . Base area magnets

11*b*', 21*b*', 41*b*', 51*b*', 51*c*', 61*b*', 61*c*', 67*b*', 67*c*' . . . Small magnets

11*c*, 51*c*, 61*c* . . . Outer circumference area magnets

11*d*, 13*h*, 14*a*, 14*c*, 14*d*, 15*a*, 16*b*, 66*b* . . . Insertion holes

12*b*, 14*b*, 22*b*, 24*b*, 42*b*, 52*b*, 52*c*, 54*b*, 54*d*, 62*b*, 62*c*, 64*b*, 68*b*, 68*c*, 69*b* . . . Sound passage ports

13*a*, 23*a*, 43*a*, 53*a*, 63*a* . . . Acoustic diaphragms

13*b*, 23*b*, 43*b*, 53*b*, 63*b* . . . Inner circumference side supporting portions

13*c*, 23*c*, 43*c*, 53*c*, 63*c* . . . Outer circumference side supporting portions

13*d*, 13*e*, 23*d*, 23*e* . . . Lead wires

13*f*, 13*g*, 23*f*, 23*g* . . . Terminal portions

14, 24, 54, 64 . . . Rear frames

15, 25*a*, 55*a* . . . Center frames

15*b*, 25*b*, 55*d*, 65*c* . . . Outer circumference frames

15*c*, 16*a* . . . Female threaded portions

16, 26, 56, 66 . . . Main frames

17*a*, 17*b*, 17*c*, 27*a*, 27*b*, 27*c*, 57*a*, 57*b*, 57*c*, 57*d*, 70*a*, 70*b* . . . Bolts

18, 28, 58*a*, 58*b*, 71*a*, 71*b* . . . Nuts

21*d* . . . Front center area magnet

21*e* . . . Front outer circumference area magnet

22*c*, 54*e*, 54*f* . . . Sound absorbing materials

25*c* . . . Center supporting frame

25*d* . . . Outer circumference supporting frame

51*d* . . . Groove portion

54*a* . . . Sound shut-off plate
55*b* . . . Intermediate supporting frame
55*c* . . . Intermediate fixing frame
55*e* . . . Spacer
65*a* . . . Rear center frame
65*b* . . . Front center frame
67 . . . Front magnet plate
67*a* . . . Front center area magnet
67*b* . . . Front base area magnet
67*c* . . . Front outer circumference area magnet
69 . . . Front frame

BEST MODE FOR CARRYING OUT THE INVENTION

Hereinafter, a description is given of a best mode for carrying out the invention with reference to the drawings.

Embodiment 1

Figure 2:
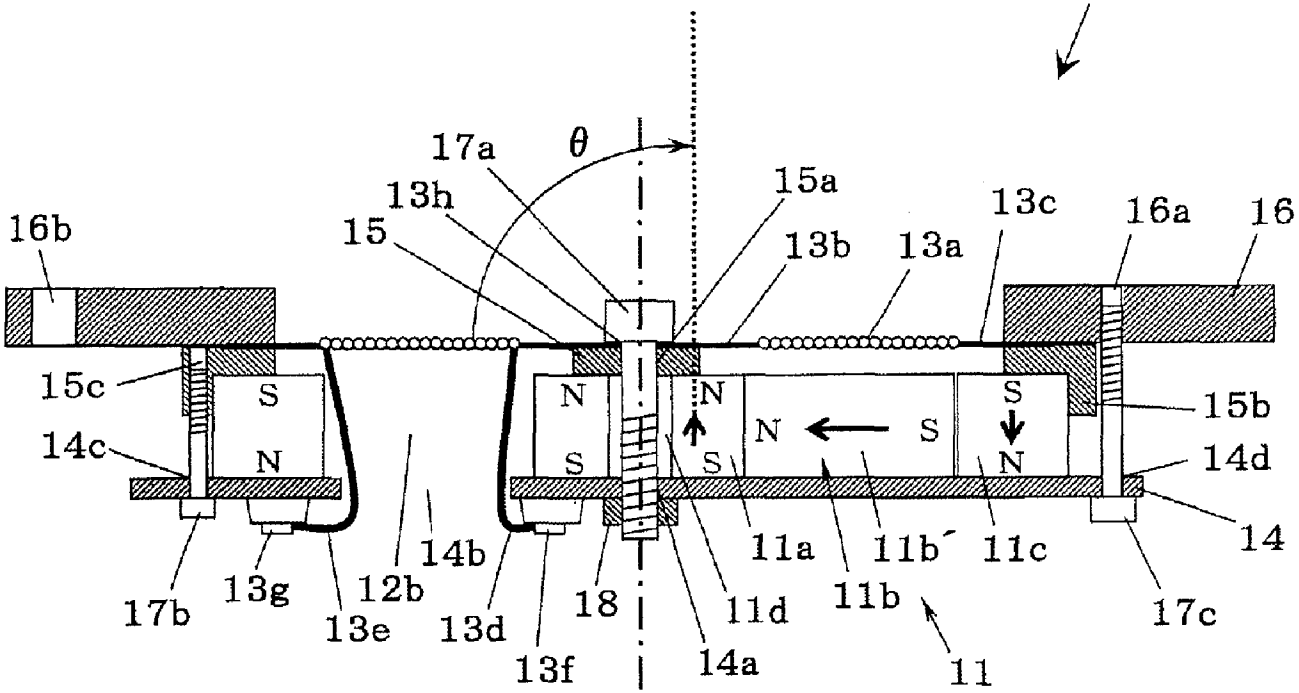
FIG. 2 is a schematically sectional end view showing the major parts of the electroacoustic transducer according to Embodiment 1.

FIG. 1 is a disassembled perspective view showing an electroacoustic transducer according to Embodiment 1. FIG. 2 is a schematically sectional end view showing the major parts of the electroacoustic transducer according to Embodiment 1.

In FIG. 1 and FIG. 2, reference numeral 10 denotes an electroacoustic transducer according to Embodiment 1, 11 denotes a magnet plate of the electroacoustic transducer 10 the entirety of which is composed to be roughly disk-shaped, 11*a* denotes a center area magnet using a ring-shaped neodymium magnet at partial areas of the magnet plate 11, 11*b* denotes a base area magnet composed of twelve trapezoidal small magnets 11*b*' using neodymium magnet at partial areas of the magnet plate 11, 11*c* denotes an outer circumference area magnet using a ring-shaped neodymium magnet at partial areas of the magnet plate 11, and 11*d* denotes an insertion hole of a bolt 17*a* secured at the middle of the center area magnet 11*a*. Reference numeral 12*b* denotes twelve sound passage ports formed between trapezoidal small magnets 11*b*' adjacent to each other in the base area magnet 11*b*. Reference numeral 13*a* denotes an acoustic diaphragm that has a planar coil formed by spirally winding an electric conductors and is installed at the front of the magnet plate 11, 13*b* denotes an inner circumference side supporting portion that is linked with the inner circumference side of the acoustic diaphragm 13*a* and resiliently supports the acoustic diaphragm 13*a* being in vibration, 13*c* denotes an outer circumference side supporting portion that is linked with the outer circumference side of the acoustic diaphragm 13*a* and resiliently supports the acoustic diaphragm 13*a* being in vibration, 13*d* denotes a lead wire at the inner circumference side of the electric conductors spirally wound at the acoustic diaphragm 13*a*, 13*e* denotes a lead wire at the outer circumference side of the electric conductors spirally wound at the acoustic diaphragm 13*a*, 13*f* denotes a terminal portion (Refer to FIG. 2), attached to the center side of a rear frame 14 described later, to which the lead wire 13*d* is connected, 13*g* denotes a terminal portion (Refer to FIG. 2), attached to the outer circumference side of the rear frame 14, to which the lead wire 13*e* is connected, and 13*h* denotes an insertion hole of a bolt 17*a* secured at the middle of the inner circumference side supporting portion 13*b*. Reference numeral 14 denotes a rear frame of the electroacoustic transducer 10, which supports the magnet plate 11 from the rear and is formed of a non-magnetic material, 14*a* denotes an insertion hole of a bolt 17*a*, which is provided at the middle of the rear frame 14, 14*b* denotes sound passage ports secured by forming a plurality of opening portions in the rear frame 14, 14*c* denotes four insertion holes of bolts 17*b*, which are provided inside the outer circumference portion of the rear frame 14, and 14*d* denotes four insertion holes of bolts 17*c*, which are provided at the outer circumference side of the rear frame 14. Reference numeral 15 denotes a center frame that is formed of a non-magnetic material to be ring-shaped and is installed at the front of the center area magnet 11*a*, 15*a* denotes an insertion hole of a bolt 17*a* secured at the middle of the center frame 15, 15*b* denotes an outer circumference frame that is formed of a non-magnetic material to be roughly L-shaped in section and is installed at the front of the outer circumference side of the outer circumference area magnet 11*c*, and 15*c* denotes four female threaded portions provided in the outer circumference frame 15*b* in order to attach the bolts 17*b*. Reference numeral 16 denotes a main frame of the electroacoustic transducer 10, which supports the entirety of the electroacoustic transducer 10 at the front thereof and is formed of a non-magnetic material, 16*a* denotes four female threaded portions secured at the main frame 16 in order to attach the bolts 17*c*, and 16*b* denotes insertion holes of bolts (not illustrated) secured at four points on the outer circumference portion of the main frame 16 in order to attach the entirety of the electroacoustic transducer 10 to an enclosure. Reference numeral 18 denotes a nut made of a non-magnetic material (Refer to FIG. 2), 17*a* denotes a bolt made of a non-magnetic material, which is screwed with the nut 18 and fixes the rear frame 14, the center area magnet 11*a*, the center frame 15, the inner circumference side supporting portion 13*b* of the acoustic diaphragm 13*a* at the center part of the acoustic diaphragm 13*a*, 17*b* denotes a bolt made of a non-magnetic material, which links the rear frame 14 and the outer circumference frame 15*b* with each other, 17*c* denotes a bolt made of a non-magnetic material, which links the rear frame 14 and the main frame 16 with each other at the outer circumference portion.

Also, for the convenience of description, FIG. 2 shows a section cut off at the position passing through the female threaded portion 16*a* of the main frame 16 at the right side of the centerline thereof, and shows a section cut off at the position passing through the insertion hole 16*b* of the main frame 16 at the left side of the centerline thereof.

The center area magnet 11*a* is fixed by inserting the bolt 17*a* into the insertion hole 13*h* of the inner circumference side supporting portion 13*b*, the insertion hole 15*a* of the center frame 15, the insertion hole 11*d* of the center area magnet 11*a*, and the insertion hole 14*a* of the rear frame 14 and being screwed with the nut 18.

The outer circumference area magnet 11*c* is fixed by being inserted between the rear frame 14 and the outer circumference frame 15*b*, inserting the bolt 17*b* into the insertion hole 14*c* of the rear frame 14 and being screwed with the female threaded portion 15*c* of the outer circumference frame 15*b*.

In the present embodiment, the outer circumference area magnet 11*c* is composed of a single ring-shaped permanent magnet. However, where it becomes difficult to handle the same as the diameter thereof increases, the outer circumference area magnet 11*c* may be composed to be ring-shaped by combining a plurality of small magnets.

A magnet force that strongly presses a plurality of small magnets 11*b*', which compose the base area magnet 11*b*, to the rear frame 14 operates between the same and the center area magnet lie and between the same and the outer circumference area magnet 11*c*, and is thereby fixed. Therefore, no other special fixing means is used. In addition, an adhesive agent may be additionally coated in order to prevent positional slip. Since the base area magnet 11*b* is pressed to the rear frame 14, the sound passage ports 14*b* being a plurality of opening portions secured in the rear frame 14 are formed so that small magnets 11*b*', which compose the base area magnet 11*b*, are formed so as not to fall out rearward.

Further, a plurality of small magnets 11*b*' that compose the base area magnet 11*b* are formed to be trapezoidal, that is, being thinner at the inner circumference side and thicker at the outer circumference side. However, the ratio between the upper bottom and the lower bottom may be appropriately selected. Also, the small magnets 11*b*' may be formed to be hexagonal other than trapezoidal. Such a method may be used as means for varying the distribution state of magnet portions at the magnet plate 11 and making uniform the magnetic flux densities for effective action of the acoustic diaphragm 13*a* with respect to the radius direction.

At the inner circumference side of the acoustic diaphragm 13*a*, the linked inner circumference side supporting portion 13*b* is inserted and fixed between the bolt 17*a* and the center frame 15. Also, at the outer circumference side of the acoustic diaphragm 13*a*, the linked outer circumference side supporting portion 13*c* is inserted and fixed between the outer circumference frame 15*b* and the main frame 16. In addition, the outer circumference side supporting portion 13*c* is inserted when fixing the main frame 16 and the rear frame 14 by means of the bolt 17*c*.

The center area magnet 11*a* jumps forward from the magnet plate 11 if the bolt 17*a* is removed. However, the center area magnet stops halfway without completely jumping out. Therefore, a plurality of small magnets 11*b*' that compose the base area magnet 11*b* are not broken into pieces. When removing the acoustic diaphragm 13*a*, if the bolt 17*a* is removed in a state where the main frame 16 is removed, the disassembling work may be easily carried out. Further, the acoustic diaphragm 13*a* may be easily assembled by reversing the removal procedures, wherein assembling work efficiency thereof is excellent.

Also, the center frame 15 and the outer circumference frame 15*b* function as a role of a spacer by which the interval between the acoustic diaphragm 13*a* vibrating forward and backward and the magnet plate 11 may be kept so that they are not made to collide with each other.

The ring-shaped thin acoustic diaphragm 13*a* is made of a single planar coil on which electric conductors composed of insulated copper-clad aluminum wire are spirally wound in one direction and the wires are cemented together by a silicone resin. A multi-layered planar coil that is stacked by a plurality of layers may be used. However, in this case, it is necessary that electric currents flowing through the planar coil are oriented in the same direction. The material of the planar coil may use insulated aluminum and copper, etc., and coils may be adhered together by a synthetic resin-based adhesive agent such as epoxy, cyanoacrylate, etc.

The lead wire 13*d* at the inner circumference side of the planar coil and the lead wire 13*e* at the outer circumference side thereof are connected to the terminal portions 13*f* and 13*g* to which a drive current is supplied from the outside. In addition, in a microphone, etc., the acoustic diaphragm 13*a* is vibrated by sound, and an electromotive force generated by an electric conductor is picked up as electric signals by means of the terminal portions 13*f* and 13*g*.

The sound passage ports 12*b* utilize gaps secured between the trapezoidal small magnets 11*b*' that compose the base area magnet 11*b*, and discharge sound generated from the rear side of the acoustic diaphragm 13*a* at the back of the electroacoustic transducer 10 along with the sound passage ports 14*b*.

The inner circumference side supporting portion 13*b* and the outer circumference side supporting portion 13*c*, formed to be like a sheet and having a suspension function that resiliently link between the center frame 15 or the outer circumference frame 15*b* and the acoustic diaphragm 13*a*, may be used. Since the amplitude of the acoustic diaphragm 13*a* in the forward and backward direction is increased where a low frequency band is reproduced, such a type that is provided with a corrugation portion enabling great resilient deformation may be used. However, in this case, the center frame 15 and the outer circumference frame 15*b* are designed so that the interval between the acoustic diaphragm 13*a* and the magnet plate 11 is widened.

The inner circumference side supporting portion 13*b* and the outer circumference side supporting portion 13*c* may be such a type that is made of rubber in addition to synthetic resin such as silicone resin and urethane resin such as urethane foam, etc. Also, such a type that is formed of a composite sheet in which synthetic resin such as silicone resin and urethane resin is impregnated in woven or nonwoven fabric made of synthetic resin fibers such as polyester fibers may be used. And the inner circumference side supporting portion 13*b* and the outer circumference side supporting portion 13*c* formed of a multi-layered composite sheet in which composite sheets are stacked and adhered to each other may be used in order to favorably maintain the shape of the corrugation portion.

Since the other manufacturing method of the acoustic diaphragm 13*a* is similar to those of the prior arts (for example, Japanese Patent No. 3612319 or Japanese Patent Application No. 2005-159862), a detailed description thereof is omitted.

FIG. 2 shows the directions of N and S poles for each of the types of the respective partial areas in the magnet plate 11. The magnetization direction of the base area magnet 11*b* in the partial areas of the magnet plate 11 is such that the magnetization angle θ with respect to the vibration plane of the acoustic diaphragm 13*a* is 0 degrees (that is, being parallel to the vibration plane of the acoustic diaphragm 13*a*), and is brought into the radius direction from the outer circumference side of the acoustic diaphragm 13*a* toward the center thereof. The magnetization angle θ of the center area magnet 11*a* is +90 degrees, that is, the forward direction of the center axis of the acoustic diaphragm 13*a*. Also, the magnetization angle θ of the outer circumference area magnet 11*c* is −90 degrees, that is, the backward direction of the center axis of the acoustic diaphragm 13*a*.

Here, a neodymium magnet is used as the material of the magnet plate 11. One ring-shaped magnet the dimensions of which are 20 mm in the outer diameter, 6 mm in the inner diameter and 10 mm thick is used as the center area magnet 11*a*, and one ring-shaped magnet the dimensions of which are 80 mm in the outer diameter, 60 mm in the inner diameter and 10 mm thick is used as the outer circumference area magnet 11*c*. And, twelve trapezoidal small magnets the dimensions of which are 4 mm for the upper bottom, 11 mm for the lower bottom, 19 mm high and 10 mm thick are used as the small magnets 11*b*' that compose the base area magnet 11*b*. Gaps between the trapezoidal small magnets 11*b*' that compose the base area magnet 11*b* are used as the sound passage ports 12*b*. Therefore, the ratio occupied by the magnet portion becomes 68% in the base area magnet 11*b* portion while the ratio occupied by the space as the sound passage ports 12*b* becomes 32%.

In addition, the gap between the acoustic diaphragm 13*a* and the magnet plate 11 is determined to be 3 mm.

Next, a description is given of a magnetic force in the backward direction of the center axis of the acoustic diaphragm 13*a*, which operates on the base area magnet 11*b*, that is, a magnetic force for pressing the base area magnet 11*b* onto the rear frame 14 of the electroacoustic transducer 10.

Generally, where it is desired that the magnetization direction of the base area magnet 11*b* becomes the radius direction toward the center of the acoustic diaphragm 13*a* with the magnetization angle θ at 0 degrees, it was found through various examinations and experiments that, with respect to the center area magnet 11*a*, the magnetic force for pressing onto the rear frame 14 is maximized when the magnetization angle θ is set to 90 degrees, and that, with respect to the outer circumference area magnet 11*c*, the magnetic force for pressing onto the rear frame 14 is maximized when the magnetization angle θ is set to −90 degrees.

Therefore, the magnetization angle adopted in the center area magnet 11*a* and the outer circumference area magnet 11*c* in Embodiment 1 becomes the magnetization angle at which the magnetic force pressing onto the rear frame 14 with respect to the base area magnet 11*b* is maximized. In Embodiment 1, neodymium is adopted as the material of the magnet. The base area magnet 11*b* is fixed by utilizing such a large magnetic force for pressing onto the rear frame 14 of the electroacoustic transducer 10.

A method for adhering to the center area magnet 11*a* and the outer circumference area magnet 11*c* by an adhesive agent, etc., without utilizing the rear frame 14 may be considered as another method for fixing trapezoidal small magnets 11*b*' that compose the base area magnet 11*b*. However, attention should be paid since, with this method, there may be a possibility for the small magnets 11*b*' to come off by a strong magnetic force if a neodymium magnet is adopted as the material of the magnet, and there is a problem in stability. Also, although a method for providing a frame, etc., to fix the base area magnet 11*b* between the magnet plate 11 and the acoustic diaphragm 13*a* may be taken into consideration, there is a tendency for the magnetic flux densities for effective action to be lowered more or less since the gap between the magnet plate 11 and the acoustic diaphragm 13*a* is widened.

In Embodiment 1, as described above, the magnetization angle and size of the base area magnet 11*b*, the center area magnet 11*a*, and the outer circumference area magnet 11*c* are determined by taking into consideration the height and uniformity of the magnetic flux densities for effective action in the acoustic diaphragm 13*a*, the width of an area having high magnetic flux densities for effective action, ease in magnetization when manufacturing a magnet, and the direction and strength of a magnetic force operating on the base area magnet 11*b*.

With the electroacoustic transducer 10 according to Embodiment 1 of the present invention as described above, the following actions may be brought about.

(1) Since the magnetization angle θ of the center area magnet 11*a* that becomes the center side of the magnet plate 11 is set to +90 degrees and the magnetization angle θ of the outer circumference area magnet 11*c* that becomes the outer circumference side is set to −90 degrees, it is possible to remarkably increase the magnetic flux densities for effective action at the electric conductors when using an acoustic diaphragm 13*a* of a general size, in comparison with a case of using a magnet plate magnetized in the radius direction. Therefore, it is possible to easily produce a speaker, a headphone, a microphone, etc., which are excellent in performance and sensitivity, in an electroacoustic transducer 10 using an acoustic diaphragm 13*a* having remarkably high sound quality.

(2) Since the magnetization angle θ of the center area magnet 11*a* that becomes the center side of the magnet plate 11 is set to +90 degrees and the magnetization angle θ of the outer circumference area magnet 11*c* that becomes the outer circumference side is set to −90 degrees, a great magnetic force for pressing onto the rear frame 14 operates on the base area magnet 11*b*. Therefore, the base area magnet 11*b* may be fixed without using any special means only by being caught by the rear frame 14, wherein since there is no need to provide a frame, etc., to fix the base area magnet 11*b* between the magnet plate 11 and the acoustic diaphragm 13*a*, the magnetic flux densities for effective action are not lowered.

(3) A special shape to fix magnets on the center area magnet 11*a*, the base area magnet 11*b* and the outer circumference area magnet 11*c* that compose the magnet plate 11 is not required.

(4) The magnetization direction of the center area magnet 11*a* and the outer circumference area magnet 11*c*, which are formed to be ring-shaped, is the axial direction, and the magnetization direction of trapezoidal small magnets 11*b*' that compose the base area magnet 11*b* is the direction from the lower bottom toward the upper bottom. Thus, since all the magnetization directions are simple, the magnetization is remarkably simple.

In addition, even if the magnet plate is composed in a state where the magnetic poles are completely inverted with respect to the magnetization direction of the partial areas described in Embodiment 1, that is, in a state where the magnetization direction of all the partial areas are turned by 180 degrees, the performance common to the above may be brought about if the poles of the drive current supplied to the terminal portions 13*f* and 13*g* are reversed.

Further, although neodymium is used as the material of the magnets, other magnets may be used. Any magnet having a high coercivity such as Sm—Co is particularly suitable. Ferrite, etc., may be used although the magnetic flux densities for effective action and the magnetic force thereof are lowered.

Embodiment 2

Figure 3:
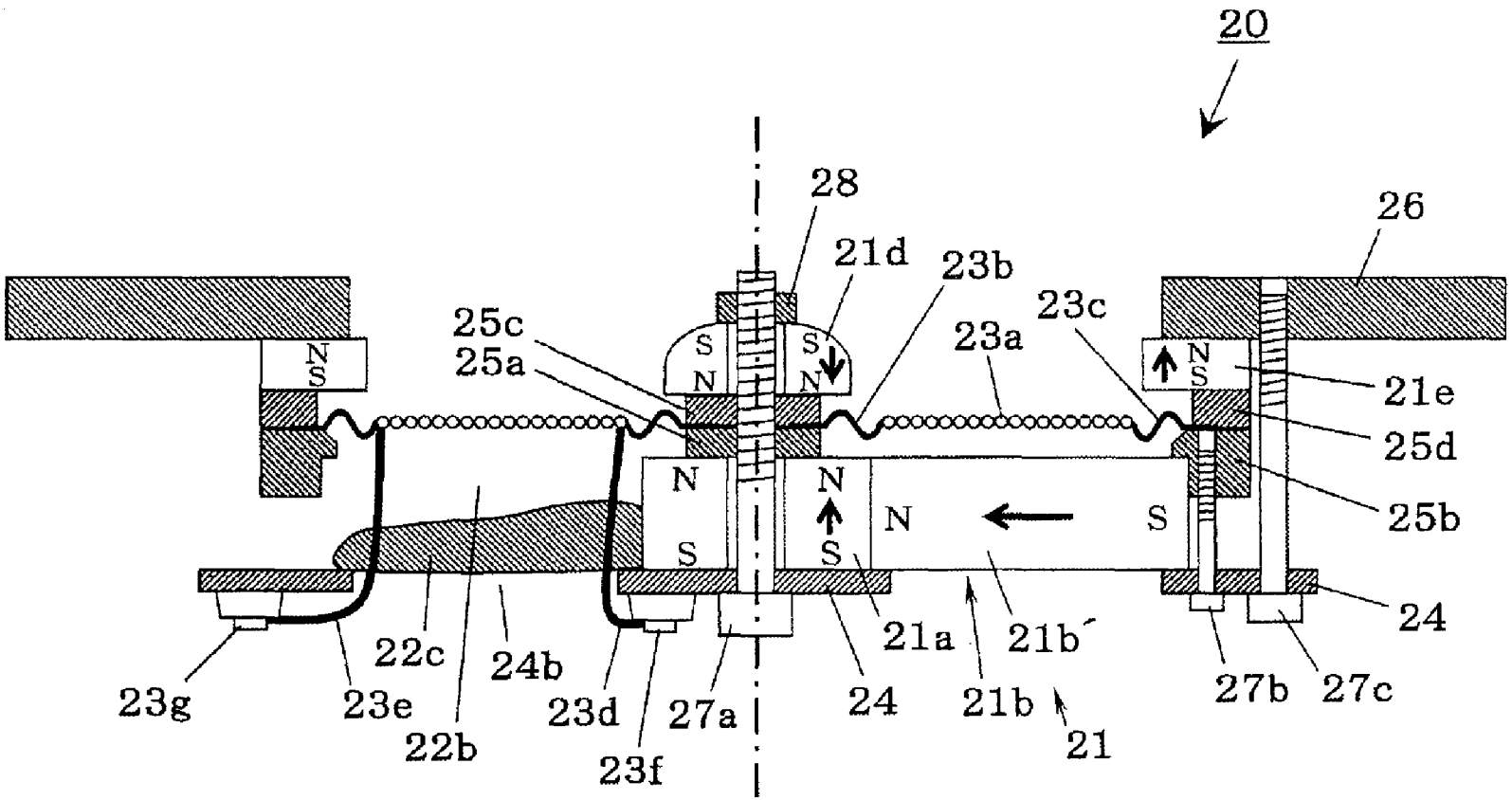
FIG. 3 is a schematically sectional end view showing the major parts of the electroacoustic transducer according to Embodiment 2.

FIG. 3 is a schematically sectional end view showing the major parts of an electroacoustic transducer according to Embodiment 2.

In FIG. 3, reference numeral 20 denotes an electroacoustic transducer according to Embodiment 2, 21 denotes a magnet plate of the electroacoustic transducer 20 the entirety of which is composed to be disk-shaped, 21*a* denotes a center area magnet using a ring-shaped neodymium magnet at partial areas of the magnet plate 21, 21*b* denotes a base area magnet composed of a plurality of trapezoidal small magnets 21*b*' using a neodymium magnet at partial areas of the magnet plate 21, 21*d* denotes a front center area magnet having a semispherical forward portion, which is installed at the front center part of an acoustic diaphragm 23*a*, is formed to be ring-shaped, and uses a neodymium magnet, and 21*e* denotes a front outer circumference area magnet that is installed at the front outer circumference portion of the acoustic diaphragm 23*a* and uses a ring-shaped neodymium magnet. Reference numeral 22*b* denotes a sound passage hole formed between trapezoidal small magnets 21*b*' adjacent to each other in the base area magnet 21*b*, and 22*c* denotes a sound absorbing material that is installed at the rear part of the sound passage port 22*b* and is composed of glass wool. Reference numeral 23*a* denotes an acoustic diaphragm that has a planar coil in which an electric conductor is spirally wound, and is installed at the front of the magnet plate 21, 23*b* denotes an inner circumference side supporting portion that is linked with the inner circumference side of the acoustic diaphragm 23*a* and resiliently supports the acoustic diaphragm 23*a* being in vibration, 23*c* denotes an outer circumference side supporting portion that is linked with the outer circumference side of the acoustic diaphragm 23*a* and resiliently supports the acoustic diaphragm 23*a* being in vibration, 23*d* denotes an inner circumference side lead wire of an electric conductor spirally wound on the acoustic diaphragm 23*a*, 23*e* denotes an outer circumference side lead wire of an electric conductor spirally wound on the acoustic diaphragm 23*a*, 23*f* denotes a terminal portion, attached to the center side of a rear frame 24 described later, to which the lead wire 23*d* is connected, and 23*g* denotes a terminal portion, attached to the outer circumference side of the rear frame 24, to which the lead wire 23*e* is connected. Reference numeral 24 denotes a rear frame of an electroacoustic transducer 20, which supports the magnet plate 21 at the rear thereof, and is formed of a non-magnetic material, and 24*b* denotes a sound passage port provided by forming a plurality of opening portions in the rear frame 24. Reference numeral 25*a* denotes a center frame that is formed of a non-magnetic material to be ring-shaped and is installed at the front of the center area magnet 21*a*, 25*b* denotes an outer circumference frame that is formed of a non-magnetic material and is installed at the front of the outer circumference side of the base area magnet 21*b*, 25*c* denotes a center supporting frame that is formed of a non-magnetic material to be ring-shaped and is installed at the back of the front center area magnet 21*d*, and 25*d* denotes an outer circumference supporting frame that is formed of a non-magnetic material to be ring-shaped and is installed at the back of the front outer circumference area magnet 21*e*. Reference numeral 26 denotes a main frame of the electroacoustic transducer 20, which supports the entirety thereof at the forward thereof and is formed of a non-magnetic material. Reference numeral 27*a* denotes a bolt made of a non-magnetic material, which is screwed in a female threaded portion of the center frame 25*a* and fixes the center area magnet 21*a* to the rear frame 24 at the center part of the acoustic diaphragm 23*a*, 27*b* denotes a bolt made of a non-magnetic material, which links the rear frame 24 and the outer circumference frame 25*b* with each other, and 27*c* denotes a bolt made of a non-magnetic material, which links the main frame 26 and the rear frame 24 with each other. Reference numeral 28 denotes a nut made of a non-magnetic material, which is screwed with the bolt 27*a* and fixes the inner circumference side supporting portion 23*b* of the acoustic diaphragm 23*a*, the center supporting frame 25*c*, and the front center area magnet 21*d* to the center frame 25*a*.

Also, for the convenience of description, as in FIG. 2, FIG. 3 shows a section cut off at the position passing through the small magnets 21*b*' of the base area magnet 21*b* at the right side of the centerline thereof, and shows a section cut off at the position passing through the sound passage port 22*b* at the left side of the centerline thereof.

The outer circumference side of a plurality of trapezoidal small magnets 21*b*' that compose the base area magnet 21*b* is fixed by being inserted between the rear frame 24 and the outer circumference frame 25*b* and by screwing the bolt 27*b* into the female threaded portion of the outer circumference frame 25*b*. Since the center side of the base area magnet 21*b* is fixed by being strongly pressed onto the rear frame 24 by means of a magnetic force operating between the same and the center area magnet 21*a*, no other fixing means is used.

Although the bolt 27*c* links the rear frame 24 and the main frame 26 to each other by being screwed in the female threaded portion formed in the main frame 26, it fixes the magnet plate 21, the outer circumference frame 25*b*, the outer circumference side supporting portion 23*c* of the acoustic diaphragm 23*a*, the outer circumference supporting frame 25*d* and the front outer circumference area magnet 21*e* by inserting these between the rear frame 24 and the main frame 26.

Further, the center frame 25*a*, the outer circumference frame 25*b*, the center supporting frame 25*c*, and the outer circumference supporting frame 25*d* also function as a role of a spacer to keep a gap so that the acoustic diaphragm 23*a* vibrating forward and backward, the inner circumference side supporting portion 23*b*, and the outer circumference side supporting portion 23*c* are not made to collide with the rear magnet plate 21, the front center area magnet 21*d*, and the front outer circumference area magnet 21*e*.

Since the acoustic diaphragm 23*a*, the lead wires 23*d*, 23*e*, and the terminal portions 23*f* and 23*g* are similar to the acoustic diaphragm 13*a*, the lead wires 13*d*, 13*e*, and the terminal portions 13*f* and 13*g* according to Embodiment 1, the descriptions thereof are omitted.

Gaps secured between trapezoidal small magnets 21*b*' that compose the base area magnet 21*b* are used as sound passage ports 22*b*, and sound generated from the rear side of the acoustic diaphragm 23*a* is discharged at the back of the electroacoustic transducer 20 via the sound passage ports 22*b*, the sound absorbing material 22*c*, and the sound passage ports 24*b*. Also, since gaps between the trapezoidal small magnets 21*b*' that compose the base area magnet 21*b* are produced at the side face side of the electroacoustic transducer 20, sound is discharged between the outer circumference frame 25*b* and the rear frame 24 through the sound passage ports 22*b*.

The inner circumference side supporting portion 23*b* and the outer circumference side supporting portion 23*c*, which are similar to the inner circumference side supporting portion 13*b* and the outer circumference side supporting portion 13*c* according to Embodiment 1 are favorably used. The inner circumference side supporting portion 23*b* has a suspension function that resiliently links the center frame 25*a*, the center supporting frame 25*c* and the acoustic diaphragm 23*a*, and the outer circumference side supporting portion 23*c* also has a suspension function that resiliently links the outer circumference frame 25*b*, the outer circumference supporting frame 25*d* and the acoustic diaphragm 23*a*.

FIG. 3 describes the directions of the N and S poles for each of the types of the respective partial areas in the magnet plate 21. In the respective partial areas, the magnetization direction of the base area magnet 21*b* is made parallel to the vibration plane of the acoustic diaphragm 23*a*, and is brought into the radius direction toward the center of the acoustic diaphragm 23*a*. The magnetization direction of the center area magnet 21*a* is brought into the forward direction of the center axis of the acoustic diaphragm 23*a*.

The front center area magnet 21*d* is composed to have the magnetization direction so as to be opposed to the center area magnet 21*a*, that is, so as to become the backward direction of the center axis of the acoustic diaphragm 23*a*. The front outer circumference area magnet 21*e* is composed to have the magnetization direction so as to be opposed to the magnetization direction of the front center area magnet 21*d*, that is, so as to become the forward direction of the center axis of the acoustic diaphragm 23*a*.

In Embodiment 1, by installing the center area magnet 11*a* and the outer circumference area magnet 11*c* that become partial areas having different magnetization directions at the center side and the outer circumference side of the base area magnet 11*b*, it was possible to concentrate the magnetic flux for effective action at the acoustic diaphragm 13*a* portion.

In Embodiment 2, remarkably high magnetic fluxes for effective action are concentrated at the acoustic diaphragm 23*a* portion by the method slightly different therefrom.

With respect to the magnetic flux distribution on the acoustic diaphragm 23*a*, which is formed by the center area magnet 21*a*, the results are brought about, which are completely identical to those of the case of installing the magnet, which is plane-symmetric to the center area magnet 21*a*, of the same size with respect to the position, shape and magnetization direction in regard to the vibration plane of the acoustic diaphragm 23*a*. Therefore, with respect to the front center area magnet 21*d* opposed to the center area magnet 21*a*, such an influence is exerted by which the magnetic fluxes for effective action are concentrated in a narrow range as in the center area magnet 21*a*. Thus, the front center area magnet 21*d* is installed for the purpose of increasing the effect exerted by the center area magnet 21*a*.

Similarly, with respect to the front outer circumference area magnet 21*e*, such an influence is exerted by which the magnetic fluxes for effective action are concentrated in a narrow range. Therefore, although a magnet is not installed at the outer circumference side of the base area magnet 21*b*, similar actions may be secured by installing the front outer circumference area magnet 21*e* at the front of the outer circumference side of the magnet plate 21 instead thereof. Thus, even if the outer circumference side magnet of the base area magnet 21*b* is eliminated in Embodiment 2, remarkably high magnetic fluxes for effective action are concentrated at the acoustic diaphragm 23*a* portion.

Further, with respect to the base area magnet 21*b*, by installing a magnet having the magnetization direction, which is made plane-symmetric to the vibration plane of the acoustic diaphragm 23*a*, at a symmetrical position with the acoustic diaphragm 23*a* inserted therebetween, it is possible to increase the magnetic flux densities for effective action. However, since adverse influence on the acoustic characteristics is increased as the reproduction frequency is increased, the magnet is not installed.

Embodiment 2 adopts a further structure of reducing adverse influence by the sound passage ports onto sound. That is, by utilizing the sound passage ports 22*b* at the portion (the outer circumference) that becomes the side face side of the electroacoustic transducer 20 without installing the outer circumference area magnet at the outer circumference of the base area magnet 21*b*, sound is discharged between the outer circumference frame 25*b* and the rear frame 24. If sound is thus discharged, the sound passage ports are made shallow, and the ratio occupied by the opening portions of the sound passage ports is also increased, wherein influence on vibrations of the acoustic diaphragm 23*a* is reduced. Further, since the types of depth of the sound passage ports are increased, it is possible to prevent the influence on vibrations of the acoustic diaphragm 23*a* from being biased to a specific frequency.

Also, there may be cases where spaces brought about between the acoustic diaphragm 23*a* and the magnet plate 21 and the sound passage ports 22*b* become a cause for resulting in resonance of the acoustic diaphragm 23*a*, which is biased to a specific frequency. In order to reduce reflected sounds that become a cause of resonance in Embodiment 2, a sound absorbing material 22*c* is installed at the back of the sound passage port 22*b*. Since sound to some degrees is caused to pass through the sound absorbing material 22*c* and is discharged at the back of the electroacoustic transducer 20 via the sound passage ports 24*b*, glass wool is installed as the sound absorbing material 22*c*. In addition, if a material such as silicone having great internal losses is coated to the portion facing the space that becomes a cause of resonance on the magnet plate 21 and the outer circumference frame 25*b*, etc., reflected sound is prevented, and similar effects may be brought about.

Thus, influence of the sound passage ports onto sound is reduced by installing the sound absorbing material 22*c* at the sound passage port 22*b* portion and discharging sound from the side face of the electroacoustic transducer 20.

Further, the front center area magnet 21*d* that is made ring-shaped has its forward part rounded to be spherical. This is because of avoiding adverse influence by which, if any sharp edge exists in portions that become a sound path, the sharp edge becomes a cause by which the frequency characteristics are subjected to ridges and recesses. Similarly, with respect to the front outer circumference area magnet 21*e*, by rounding the corners of the portion that become a sound path, there may be cases where the frequency characteristics may be flattened.

Next, a description is given of a magnetic force in the backward direction of the center axis of the acoustic diaphragm 23*a*, which operates on the base area magnet 21*b*, that is, a magnetic force for pressing the base area magnet 21*b* onto the rear frame 24.

Generally, where the magnetization direction of the base area magnet 21*b* is made parallel to the vibration plane of the acoustic diaphragm 23*a* and is composed to become the radius direction toward to the center of the acoustic diaphragm 23*a*, the magnetic force for pressing the base area magnet 21*b* to the rear frame 24 is maximized where the magnetization direction of the center area magnet 21*a* is the forward direction of the center axis. Therefore, the magnetization direction adopted in the center area magnet 21*a* of Embodiment 2 becomes the magnetization angle at which the magnetic force pressing onto the rear frame 24 with respect to the base area magnet 21*b* is maximized. Embodiment 2 adopts neodymium as the material of the magnet, and the center side of the base area magnet 21*b* is fixed by utilizing such a magnetic force for strongly pressing onto the rear frame 24.

As described above, in Embodiment 2, the magnetization angle, size and composing method of the magnet plate 21, the front center area magnet 21*d* and the front outer circumference area magnet 21*e* are determined by taking into consideration influence of the sound passage ports, height and uniformity of the magnetic flux densities for effective action at the acoustic diaphragm 23*a*, ease in magnetization when manufacturing a magnet, and the method for fixing the base area magnet 21*b*.

With the electroacoustic transducer 20 according to Embodiment 2 of the present invention, which is described above, the following actions may be brought about in addition to those of Embodiment 1.

(1) By installing the front center area magnet 21*d* at the front center side of the acoustic diaphragm 23*a* and adopting the magnetization direction so as to be opposed to the center area magnet 21*a*, the magnetic fluxes for effective action may be further concentrated at the acoustic diaphragm 23*a* portion, wherein the densities may be increased.

(2) By eliminating the magnet at the outer circumference side of the base area magnet 21*b*, it is possible to form opening portions that become the sound passage ports 22*b* between the small magnets 21*b*', which compose the base area magnet 21*b*, also at the portion (the outer circumference) that becomes the side face side of the electroacoustic transducer 20. Since sound is discharged from the sides of the electroacoustic transducer 20 also through the opening portions, the sound passage ports 22*b* may be made shallow in depth and influence on vibrations of the acoustic diaphragm 23*a* may be reduced. In addition, since the types of depth of the sound passage ports 22*b* are increased, it is possible to prevent the influence on vibrations of the acoustic diaphragm 23*a* from being biased to a specific frequency.

(3) By installing the front outer circumference area magnet 21*e* at the front outer circumference side of the acoustic diaphragm 23*a* and setting the magnetization direction to a roughly reverse direction of the front center area magnet 21*d*, it is possible to compensate for the influence brought about by eliminating the magnet at the outer circumference side of the base area magnet 21*b*.

(4) Edge parts are reduced at the parts, which become sound paths, by forming the forward part of the ring-shaped front center area magnet 21*b* to be semispherically round. Therefore, a cause by which ridges and recesses are produced in the frequency characteristics is excluded, wherein the frequency characteristics may be flattened.

(5) Since the outer circumference side of the base area magnet 21*b* is inserted between the rear frame 24 and the outer circumference frame 25*b* and is tightened by the bolt 27*b*, the base area magnet 21*b* may be securely fixed. In comparison with a case where the base area magnet 21*b* is fixed only by the magnetic force for pressing onto the rear frame 24, the base area magnet 21*b* may be securely fixed even where the magnetic force is weakened by influences of the material, etc., of the magnet, wherein the design versatility and fixing stability are made excellent.

(6) Since the sound absorbing material 22*c* is installed at the sound passage port 22*b* portion, reflected sound in a spacing portion is reduced, wherein it is possible to reduce resonance of the acoustic diaphragm 23*a*, which is biased to a specific frequency.

Embodiment 3

Figure 4:
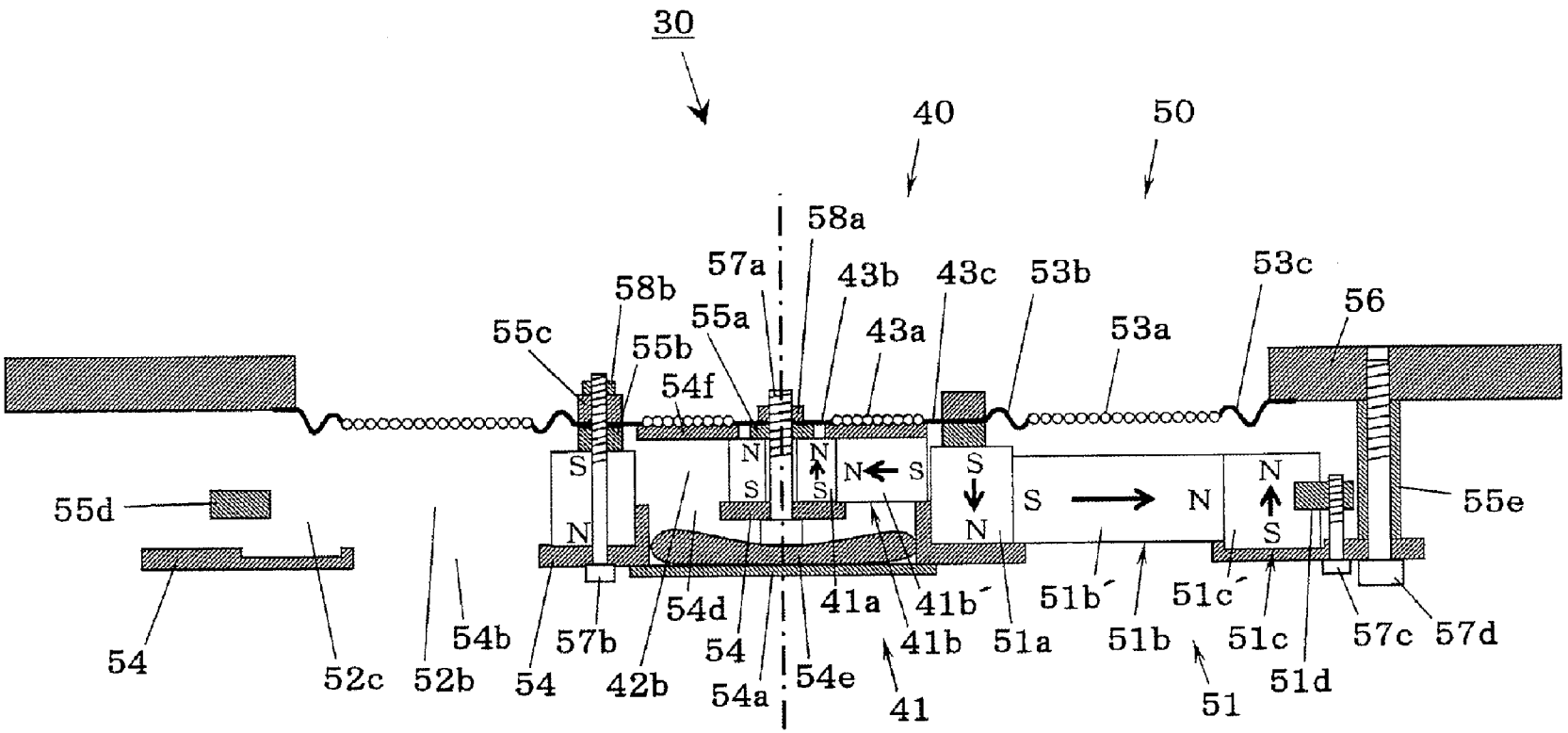
FIG. 4 is a schematically sectional end view showing the major parts of the electroacoustic transducer according to Embodiment 3.

FIG. 4 is a schematically sectional end view showing the major parts of an electroacoustic transducer according to Embodiment 3.

In FIG. 4, reference numeral 30 denotes a composite-type electroacoustic transducer according to Embodiment 3, which is composed by concentrically disposing a high-range electroacoustic transducer 40 and a low-range electroacoustic transducer 50 each of which is independently formed. Reference numeral 41 denotes a magnet plate of a high-range electroacoustic transducer 40, the entirety of which is composed to be disk-shaped, 41*a* denotes a high-range center area magnet using a ring-shaped neodymium magnet at a partial area of the high-range magnet plate 41, and 41*b* denotes a high-range base area magnet composed of a plurality of trapezoidal small magnets 41*b*' each using a neodymium magnet at a partial area of the high-range magnet plate 41. Reference numeral 42*b* denotes a high-range sound passage port formed between the trapezoidal small magnets 41*b*' adjacent to each other in the high-range base area magnet 41*b*. Reference numeral 43*a* denotes an acoustic diaphragm of the high-range electroacoustic transducer 40, which has a planar coil having an electric conductor spirally wound and is installed at the front of the high-range magnet plate 41, 43*b* denotes an inner circumference side supporting portion that is linked to the inner circumference side of the high-range acoustic diaphragm 43*a* and resiliently supports the high-range acoustic diaphragm 43*a* being in vibration, and 43*c* denotes an outer circumference side supporting portion that is linked to the outer circumference side of the high-range acoustic diaphragm 43*a* and resiliently supports the high-range acoustic diaphragm 43*a* being in vibration. Reference numeral 51 denotes a magnet plate of the low-range electroacoustic transducer 50, the entirety of which is composed to be ring-shaped, 51*a* denotes a center area magnet using a ring-shaped neodymium magnet at a partial area of the low-range magnet plate 51, 51*b* denotes a base area magnet composed of a plurality of trapezoidal small magnets 51*b*' each using a neodymium magnet at a partial area of the low-range magnet plate 51, 51*c* denotes an outer circumference area magnet composed of a plurality of rectangular-parallelepiped-shaped small magnets 51*c*' each using a neodymium magnet at a partial area of the low-range magnet plate 51, and 51*d* denotes a groove portion formed on the outer circumference plane of the respective small magnets 51*c*' that compose the outer circumference area magnet 51*c*. Reference numeral 52*b* denotes a low-range sound passage port formed between the trapezoidal small magnets 51*b*' adjacent to each other at the low-range base area magnet 51*b*, and 52*c* denotes an outer circumference side sound passage port formed between the rectangular-parallelepiped-shaped small magnets 51*c*' adjacent to each other at the low-range outer circumference area magnet 51*c*. Reference numeral 53*a* denotes a low-range acoustic diaphragm that has a planar coil having an electric conductor spirally wound and is installed at the front of the low-range magnet plate 51, 53*b* denotes an inner circumference side supporting portion that is linked to the inner circumference side of the low-range acoustic diaphragm 53*a* and resiliently supports the low-range acoustic diaphragm 53*a* being in vibration, and 53*c* denotes an outer circumference side supporting portion that is linked to the outer circumference side of the low-range acoustic diaphragm 53*a* and resiliently supports the low-range acoustic diaphragm 53*a* being in vibration. Reference numeral 54 denotes a rear frame of the electroacoustic transducer 30, formed of a non-magnetic material, which supports the high-range magnet plate 41 and the low-range magnet plate 51 at the rear thereof, 54*a* denotes a sound shut-off plate of the high-range electroacoustic transducer 40, which is formed of a non-magnetic material to be disk-shaped, and is attached to the back of the high-range electroacoustic transducer 40, 54*b* denotes low-range sound passage ports provided by forming a plurality of opening portions at the back of the low-range base area magnet 51*b* in the rear frame 54, 54*d* denotes high-range sound passage ports provided by forming a plurality of opening portions at the back of the high-range base area magnet 41*b* at the rear frame 54, 54*e* denotes a rear sound absorbing material that is installed between the high-range electroacoustic transducer 40 and the sound shut-off plate 54*a* and is composed of glass wool, and 54*f* denotes a supporting sound absorbing material that is formed to be ring-shaped, is inserted between the high-range acoustic diaphragm 43*a* and the high-range magnet plate 41 and is composed of glass wool. Reference numeral 55*a* denotes a center frame that is formed of a non-magnetic material to be thin and ring-shaped, and is installed at the front of the high-range center area magnet 41*a*, 55*b* denotes an intermediate supporting frame that is formed of a non-magnetic material to be ring-shaped, and is installed at the front of the low-range center area magnet 51*a*, 55*c* denotes an intermediate fixing frame that is formed of a non-magnetic material to be ring-shaped and is installed at the front of the outer circumference side supporting portion 43*c* of the high-range acoustic diaphragm 43*a* and of the inner circumference side supporting portion 53*b* of the low-range acoustic diaphragm 53*a*, 55*d* denotes an outer circumference frame that is formed of a non-magnetic material and is installed to be fitted in the groove portion 51*d* at the outer circumference side of the respective small magnets 51*c*' of the low-range outer circumference area magnet 51*c*, and 55*e* denotes a spacer made of a non-magnetic material, which keeps the interval constant between a main frame 56 described later and the rear frame 54 fixed at the outer circumference portion of the low-range magnet plate 51. Reference numeral 56 denotes a main frame of the electroacoustic transducer 30, which is formed of a non-magnetic material and supports the entirety of the electroacoustic transducer 30 at the front of the low-range magnet plate 51. Reference numeral 57*a* denotes a bolt made of a non-magnetic material, which is screwed in a nut 58*a* made of a non-magnetic material and fixes an inner circumference side supporting portion 43*b* of the high-range acoustic diaphragm 43*a*, the center frame 55*a*, the high-range center area magnet 41*a*, and the rear frame 54 at the center part of the high-range acoustic diaphragm 43*a*. Reference numeral 57*b* denotes a bolt made of a non-magnetic material, which is screwed in the female threaded portion formed on the circumference of the intermediate supporting frame 55*b* and fixes the low-range center area magnet 51*a* at the rear frame 54, 57*c* denotes a bolt made of a non-magnetic material, which is screwed in the female threaded portion formed on the circumference of the outer circumference frame 55*d* and fixes the low-range outer circumference area magnet 51*c* at the rear frame 54, and 57*d* denotes a bolt made of a non-magnetic material, which links the rear frame 54 and the main frame 56 with each other at the outer circumference portion. Reference numeral 58*b* denotes a nut made of a non-magnetic material, which is screwed with the bolt 57*b* and fixes the outer circumference side supporting portion 43*c* of the high-range acoustic diaphragm 43*a* and the inner circumference side supporting portion 53*b* of the low-range acoustic diaphragm 53*a* at the intermediate supporting frame 55*b* along with the intermediate fixing frame 55*c*.

Further, for the convenience of description, FIG. 4 shows a section cut off at the position passing through the small magnets 51*b*' of the low-range base area magnet 51*b* at the right side of the centerline thereof, and shows a section cut off at the position passing through the low-range sound passage ports 52*b* at the left side of the centerline thereof.

The low-range center area magnet 51*a* is provided with a through hole through which the bolt 57*b* is passed. Also, a plurality of rectangular-parallelepiped-shaped small magnets 51*c*' that compose the low-range outer circumference area magnet 51*c* have a groove portion and are fixed at the rear frame 54 by screwing the bolt 57*c* in the female threaded portion, which is formed on the circumference of the outer circumference frame 55*d*, through the outer circumference frame 55*d* in the groove portion. Although a groove is provided in the rear frame 54, and a plurality of small magnets 51*c*' that compose the low-range outer circumference area magnet 51*c* are embedded therein, the entirety thereof is thus prevented from being disassembled by the magnetic forces repelling each other when combining the small magnets 51*c*'.

Although the rear frame 54 and the main frame 56 are linked with each other by the bolt 57*d*, the gap therebetween is maintained constant at the outer circumference portion by means of the spacer 55*e*. In addition, the outer circumference side supporting portion 53*c* of the low-range acoustic diaphragm 53*a* is fixed by the outer circumference portion thereof being adhered to the rear face of the inner circumference side of the main frame 56.

The center frame 55*a* and the intermediate supporting frame 55*b* serve as a spacer by which a gap is secured so that the high-range acoustic diaphragm 43*a* and the low-range acoustic diaphragm 53*a*, which vibrate forward and backward, are not made to collide with the rear high-range magnet plate 41 and the rear low-range magnet plate 51. Further, since the amplitude of the low-range acoustic diaphragm 53*a* that reproduces a low frequency band is increased, the low-range magnet plate 51 is further slid rearward in comparison with the high-range magnet plate 41 in order to widen the above-described gap. Also, the magnetic flux densities for effective action and the utilization efficiency of magnetic flux are improved by designing the low-range center area magnet 51*a* so that the low-range center area magnet 51*a* is made to approach the low-range acoustic diaphragm 53*a* by being moved slightly forward than the low-range base area magnet 51*b*. In the case of thus installing, the length of moving forward is determined in such a range in which the inner circumference side supporting portion 53*b* is not brought into contact with the low-range center area magnet 51*a* even if the acoustic diaphragm 53*a* is brought into maximum amplitude.

The high-range acoustic diaphragm 43*a* inserts the supporting sound absorbing material 54*f* along with the high-range magnet plate 41. That is, by causing the supporting sound absorbing material 54*f* to be brought into contact with the entirety of the rear side of the high-range acoustic diaphragm 43*a*, the high-range acoustic diaphragm 43*a* is resiliently supported uniformly by the supporting sound absorbing material 54*f*. Thus, by causing the supporting sound absorbing material 54*f* to have not only the sound absorbing function but also a function to control the high-range acoustic diaphragm 43*a*, generation of any small separate vibrations does not occur. In this case, as the material of the supporting sound absorbing material 54*f*, not only glass wool but also a nonwoven fabric using polypropylene resin, polyethylene resin, polyester resin, etc., and a material having breathability in a foamed resin, etc., the material of which is polyethylene resin, polyurethane resin, etc., may be favorably used.

The gaps secured between the trapezoidal small magnets 41*b*' that compose the high-range base area magnet 41*b* are utilized as the high-range sound passage ports 42*b*, and discharge sound generated from the rear side of the high-range acoustic diaphragm 43*a* at the back of the high-range electroacoustic transducer 40 together with the high-range sound passage ports 54*d*. In addition, the gaps secured between the trapezoidal small magnets 51*b*' that compose the low-range base area magnet 51*b* are utilized as the low-range sound passage ports 52*b* and discharge sound generated from the rear side of the low-range acoustic diaphragm 53*a* at the back of the low-range electroacoustic transducer 50 together with the low-range sound passage ports 54*b*.

The low-range base area magnet 51*b* and the low-range outer circumference area magnet 51*c* are installed so that the positions of the low-range sound passage ports 52*b* and the outer circumference side sound passage ports 52*c*, which are formed between the respective small magnets 51*b*' and 51*c*', are made coincident with each other. Thus, sound generated from the rear side of the low-range acoustic diaphragm 53*a* may be discharged also between the outer circumference frame 55*d* and the rear frame 54 by being bypassed through the low-range sound passage ports 52*b* and the outer circumference side sound passage ports 52*c*.

In Embodiment 3, sound generated from the rear side of the low-range acoustic diaphragm 53*a* is discharged to the side face side of the low-range electroacoustic transducer 50, passing between the main frame 56 and the low-range outer circumference area magnet 51*c* in addition thereto. That is, by placing a spacer 55*e* between the main frame 56 and the rear frame 54, space is secured between the main frame 56 and the low-range outer circumference area magnet 51*c*, whereby the sound is discharged to the outside from the side face side of the low-range electroacoustic transducer 50.

In this case, it is important that the main frame 56 is installed as forward as possible with respect to the low-range acoustic diaphragm 53*a* because the space to discharge sound may be widely secured. Therefore, in Embodiment 3, the corrugation portion of the outer circumference side supporting portion 53*c* of the low-range acoustic diaphragm 53*a* is fixed at the most forward part thereof so that it is connected to the main frame 56 as forward as possible. Such a method is remarkably effective as a countermeasure for reducing influence of the sound passage ports, which is exerted on the acoustic characteristics, by increasing the area of opening portions that become the sound passage ports.

Sound generated from the rear side of the low-range acoustic diaphragm 53*a* and sound generated from the rear side of the high-range acoustic diaphragm 43*a* are prevented from causing interference with each other by providing the sound shut-off plate 54*a*. That is, the sound shut-off plate 54*a* is adhered to the rear frame 54 so as to close the sound shut-off plate 54*a* at the back of the high-range electroacoustic transducer 40, wherein the respective sounds are completely shut off to prevent interference. Also, sound generated from the rear side of the high-range acoustic diaphragm 43*a* is absorbed by the rear sound absorbing material 54*e* installed between the high-range electroacoustic transducer 40 and the sound shut-off plate 54*a*.

The thin ring-shaped high-range acoustic diaphragm 43*a* that is similar to the acoustic diaphragm 13 according to Embodiment 1 is used. The thin ring-shaped low-range acoustic diaphragm 53*a* is such that two planar coils in which an electric conductor consisting of insulated copper-clad aluminum wire is spirally wound in one direction and cemented together by a silicone resin are adhered to each other. The mechanical strength is secured by adhering two planar coils together, wherein the low-range acoustic diaphragm 53*a* is prevented from being torn and damaged when reproducing a low frequency band the amplitude of which is increased. Also, lead wires (not illustrated) are connected to the respective planar coils as in Embodiments 1 and 2, and are connected to the terminal portions (not illustrated) to which a drive current is supplied from the outside.

The composite-type electroacoustic transducer 30 according to Embodiment 3 is composed by coaxially (concentrically) disposing the high-range electroacoustic transducer 40 to reproduce high frequency range and the low-range electroacoustic transducer 50 to reproduce low frequency range. Therefore, the center axis of the high-range acoustic diaphragm 43*a* and the center axis of the low-range acoustic diaphragm 53*a* are common to each other.

Although the inner circumference side supporting portion 53*b* and the outer circumference side supporting portion 53*c* having a corrugation portion formed therein are used since the amplitude of the low-range acoustic diaphragm 53*a* is increased, the inner circumference side supporting portion 43*b* and the outer circumference side supporting portion 43*c* is formed as a flat shape since the amplitude of the high-range acoustic diaphragm 43*a* is not increased. The inner circumference side supporting portion 43*b* and the outer circumference side supporting portion 43*c*, which are made of a synthetic resin such as silicone resin, etc., and rubber, may be used. The inner circumference side supporting portion 53*b* and the outer circumference side supporting portion 53*c* that support the low-range acoustic diaphragm 53*a* the amplitude of which is increased adopt a composite sheet in which a synthetic resin such as silicone resin is impregnated in woven fabric formed of synthetic resin fibers such as polyester fibers in order to increase the mechanical strength. In addition, a multi-layered composite sheet may be used, in which the composite sheets are stacked and adhered to each other in order to favorably maintain the shape of the corrugation.

FIG. 4 describes the directions of the N and S poles for each of the types of the respective partial areas of a magnet. The magnetization direction of the high-range base area magnet 41*b* in the respective partial areas is made parallel to the vibration plane of the high-range acoustic diaphragm 43*a* and is brought into the radius direction toward the center of the high-range acoustic diaphragm 43*a*. The magnetization direction of the high-range center area magnet 41*a* is brought into the forward direction of the center axis of the high-range acoustic diaphragm 43*a*.

In addition, the magnetization direction of the low-range center area magnet 51*a* is brought into the backward direction of the center axis of the high-range acoustic diaphragm 43*a*. The magnetization direction of the low-range base area magnet 51*b* generally becomes the direction opposite to the high-range base area magnet 41*b*. Therefore, the magnetization direction of the low-range base area magnet 51*b* is opposite to the magnetization direction of the high-range base area magnet 41*b*, that is, is brought into the radius direction toward the outer circumference of the low-range acoustic diaphragm 53*a*. The magnetization direction of the low-range outer circumference area magnet 51*c* is determined with respect to the low-range base area magnet 51*b* and is brought into the forward direction of the center axis of the low-range acoustic diaphragm 53*a*.

In Embodiment 1, by installing the center area magnet 11*a* and the outer circumference area magnet 11*c*, which have a different magnetization direction, at the center side and the outer circumference side of the base area magnet 11*b* the magnetization direction of which is brought into the radius direction of the acoustic diaphragm, the magnetic fluxes for effective action are concentrated to increase the density thereof. Even in Embodiment 3, the means similar thereto is adopted to form remarkably high magnetic flux densities for effective action. That is, with respect to the low-range base area magnet 51*b*, the low-range center area magnet 51*a* that becomes the center side thereof and the low-range outer circumference area magnet 51*c* that becomes the outer circumference side thereof are disposed. Further, with respect to the high-range base area magnet 41*b*, the high-range center area magnet 41*a* that becomes the center side thereof is disposed.

Also, the low-range center area magnet 51*a* of the magnet plate 51 is arranged at the outer circumference side of the high-range base area magnet 41*b*. However, the low-range center area magnet 51*a* may concurrently have a function as the outer circumference area magnet with respect to the high-range base area magnet 41*b* in addition to a function as the center area magnet with respect to the low-range base area magnet 51*b*.

In Embodiment 3, magnetic fluxes for effective action are thus concentrated at the electric conductor portion of the high-range acoustic diaphragm 43*a* and the low-range acoustic diaphragm 53*a*, wherein a composite-type electroacoustic transducer 30 is brought about in which a high-range electroacoustic transducer 40 and a low-range electroacoustic transducer 50 are coaxially disposed while forming a distribution of high magnetic flux densities for effective action.

A force for strongly pressing the high-range base area magnet 41*b* to the rear frame 54 operates on the high-range base area magnet 41*b* by means of a magnetic force operating between the same and the high-range center area magnet 41*a* and a magnetic force operating between the same and the low-range center area magnet 51*a*, and is thereby fixed. Therefore, no other fixing means is used. Further, with respect to the low-range base area magnet 51*b*, the magnetization direction thereof is opposed to that of the high-range base area magnet 41*b*. The magnetization directions of the low-range center area magnet 51*a* located at the center side thereof and the low-range outer circumference area magnet 51*c* located at the outer circumference side thereof are also opposite to the magnetization direction of the high-range center area magnet 41*a* and the low-range center area magnet 51*a* corresponding to the high-range outer circumference area magnet. Therefore, since a magnetic force for strongly pressing the low-range base area magnet 51*b* to the rear frame 54 operates thereon to fix the low-range base area magnet 51*b*, no other fixing means is used.

With the electroacoustic transducer 30 according to Embodiment 3 of the present invention, which is thus constructed, the following actions are brought about in addition to those described with respect to Embodiments 1 and 2.

(1) Since a high-range electroacoustic transducer 40 and a low-range electroacoustic transducer 50, which are according to the present invention, are independent from each other and have different sizes and acoustic characteristics from each other, are combined and made into a composite-type, these transducers may be integrally installed appropriately arranged according to the application conditions such as the radiation area of sound and weight in the high-range acoustic diaphragm 43*a* and the low-range acoustic diaphragm 53*a*. Therefore, the respective features per frequency range maybe utilized with the high-range electroacoustic transducer 40 and the low-range electroacoustic transducer 50 combined, wherein it is possible to compose a composite-type electroacoustic transducer 30 having excellent performance in all the frequency ranges.

(2) Since a high-range electroacoustic transducer 40 and a low-range electroacoustic transducer 50 are concentrically (coaxially) arranged to compose a composite-type, it is possible to obtain a composite-type electroacoustic transducer 30 that is excellent in the phase characteristics and the directivity characteristics.

(3) The low-range center area magnet 51*a* functions not only as a center area magnet in the low-range magnet plate 51 but also as an outer circumference area magnet in the high-range magnet plate 41. Therefore, it is possible to improve the utilization efficiency of magnetic fluxes by effectively utilizing the restricted area of the magnet, and since a partial area magnet for one type thereof is not required, the volume of magnets used may be reduced.

(4) Sound generated from the rear side of the low-range acoustic diaphragm 53*a* may be discharged between the main frame 56 and the low-range outer circumference area magnet 51*c*. Accordingly, since sound may be discharged directly to the outside without bypassing the low-range magnet plate 51, influence of the sound passage ports on vibrations of the acoustic diaphragm 53*a* may be reduced.

Embodiment 4

Figure 5:
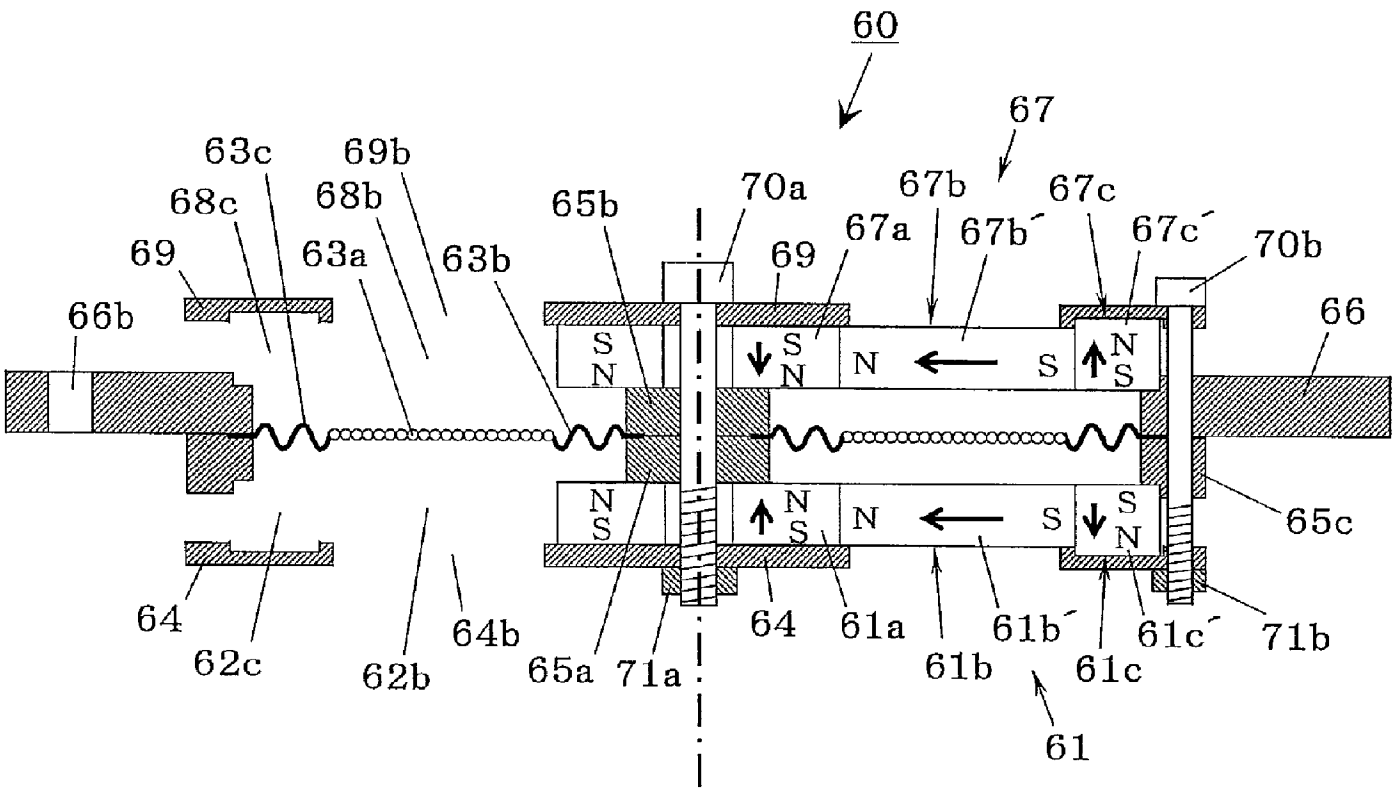
FIG. 5 is a schematically sectional end view showing the major parts of the electroacoustic transducer according to Embodiment 4.

FIG. 5 is a schematically sectional end view showing the major parts of the electroacoustic transducer according to Embodiment 4.

In FIG. 5, reference numeral 60 denotes an electroacoustic transducer according to Embodiment 4. Reference numeral 61 denotes a rear magnet plate of the electroacoustic transducer 60 the entirety of which is composed to be disk-shaped, 61*a* denotes a rear center area magnet using a ring-shaped neodymium magnet at a partial area of the rear magnet plate 61, 61*b* denotes a rear base area magnet that is composed of a plurality of trapezoidal small magnets 61*b*' using a neodymium magnet at a partial area of the rear magnet plate 61, and 61*c* denotes a rear outer circumference area magnet that is composed of a plurality of rectangular-parallelepiped-shaped small magnets 61*c*' using a neodymium magnet at a partial area of the rear magnet plate 61. Reference numeral 62*b* denotes a sound passage port formed between trapezoidal small magnets 61*b*' adjacent to each other at the rear base area magnet 61*b*, and 62*c* denotes a sound passage port formed between the rectangular-parallelepiped-shaped small magnets 61*c*' adjacent to each other at the rear outer circumference area magnet 61*c*. Reference numeral 63*a* denotes an acoustic diaphragm having a planar coil on which an electric conductor is spirally wound and is installed at an intermediate portion between the rear magnet plate 61 and a front magnet plate 67 described later, 63*b* denotes an inner circumference side supporting portion that is linked to the inner circumference side of the acoustic diaphragm 63*a* and resiliently supports the acoustic diaphragm 63*a* being in vibration, and 63*c* denotes an outer circumference side supporting portion that is linked to the outer circumference side of the acoustic diaphragm 63*a* and resiliently supports the acoustic diaphragm 63*a* being in vibration. Reference numeral 64 denotes a rear frame of the electroacoustic transducer 60, which supports the rear magnet plate 61 at the back thereof and is formed of a non-magnetic material, and 64*b* denotes a sound passage port provided by forming a plurality of opening portions in the rear frame 64. Reference numeral 65*a* denotes a rear center frame that is formed of a non-magnetic material to be ring-shaped and is installed at the front (at the back of the acoustic diaphragm 63*a*) of the rear center area magnet 61*a*, 65*b* denotes a front center frame that is formed of a non-magnetic material to be ring-shaped and is installed at the front of the acoustic diaphragm 63*a*, and 65*c* denotes an outer circumference frame that is formed of a non-magnetic material and is installed at the front of the outer circumference side of the rear outer circumference area magnet 61*c*. Reference numeral 66 denotes a main frame of the electroacoustic transducer 60, which supports the entirety of the electroacoustic transducer 60 at the front of the outer circumference portion of the acoustic diaphragm 63*a* and is formed of a non-magnetic material, and 66*b* denotes insertion holes of bolts (not illustrated) provided at six points at the outer circumference portion of the main frame 66 in order to attach the entirety of the electroacoustic transducer 60 to an enclosure. Reference numeral 67 denotes a front magnet plate of the electroacoustic transducer 60, which is disposed at the front part of the electroacoustic transducer 60 and has the entirety composed to be disk-shaped, 67*a* denotes a front center area magnet using a ring-shaped neodymium magnet at a partial area of the front magnet plate 67, 67*b* denotes a front base area magnet composed of a plurality of trapezoidal small magnets 67*b*' using a neodymium magnet at a partial area of the front magnet plate 67, and 67*c* denotes a front outer circumference area magnet composed of a plurality of rectangular-parallelepiped-shaped small magnets 67*c*' using a neodymium magnet at a partial area of the front magnet plate 67. Reference numeral 68*b* denotes a sound passage port formed between the trapezoidal small magnets 67*b*' adjacent to each other at the front base area magnet 67*b*, and 68*c* denotes a sound passage port formed between the rectangular-parallelepiped-shaped small magnets 67*c*' adjacent to each other at the front outer circumference area magnet 67*c*. Reference numeral 69 denotes the front frame of the electroacoustic transducer 60, which supports the front magnet plate 67 at the front thereof and is formed of a non-magnetic material, and 69*b* denotes a sound passage port provided by forming a plurality of opening portions in the front frame 69. Reference numeral 70*a* denotes a bolt made of a non-magnetic material, which is screwed in a nut 71*a* made of a non-magnetic material and fixes the rear frame 64, the rear center area magnet 61*a*, the rear center frame 65*a*, the inner circumference side supporting portion 63*b* of the acoustic diaphragm 63*a*, the front center frame 65*b*, the front center area magnet 67*a*, and the front frame 69 at the center part of the acoustic diaphragm 63*a*, 70*b* denotes a bolt made of a non-magnetic material, which is screwed in a nut 71*b* made of a non-magnetic material and fixes the rear frame 64, the rear outer circumference area magnet 61*c*, the outer circumference frame 65*c*, the outer circumference side supporting portion 63*c* of the acoustic diaphragm 63*a*, the main frame 66, the front outer circumference area magnet 67*c*, and the front frame 69 at the outer circumference portion of the acoustic diaphragm 63*a*.

In addition, for the convenience of description, FIG. 5 shows a section cut off at the position passing through the small magnets 61*b*' of the rear base area magnet 61*b* at the right side of the centerline thereof, and shows a section cut off at the position passing through the sound passage port 62*b* at the left side of the centerline thereof.

The rear center area magnet 61*a* and the front center area magnet 67*a* are provided with a through hole through which the bolt 70*a* is passed. A plurality of rectangular-parallelepiped-shaped small magnets 61*c*' that compose the rear outer circumference area magnet 61*c* are inserted between the rear frame 64 and the outer circumference frame 65*c*, and a plurality of rectangular-parallelepiped-shaped small magnets 67*c*' that compose the front outer circumference area magnet 67*c* are inserted between the front frame 69 and the main frame 66 and are fixed by screwing the bolt 70*b* in the nut 71*b*.

The center area magnet 61*a*, the base area magnet 61*b*, and the outer circumference area magnet 61*c* of the rear magnet plate 61, and the front center area magnet 67*a*, the front base area magnet 67*b* and the front outer circumference area magnet 67*c* of the front magnet plate 67 are disposed symmetrical to each other with the acoustic diaphragm 63*a* inserted therebetween, respectively, and the respective magnetization directions thereof are made symmetrical (plane-symmetrical) to the vibration plane of the acoustic diaphragm 63*a*.

The rear base area magnet 61*b* is given a force by which the rear base area magnet 61*b* is strongly pressed to the rear frame 64 by means of a magnetic force operating between the same and the rear center area magnet 61*a* and between the same and the rear outer circumference area magnet 61*c*, and is thereby fixed thereto. Similarly, the front base area magnet 67*b* is given a force by which the front base area magnet 67*b* is intensively pressed to the front frame 69 by means of a magnetic force operating between the same and the front center area magnet 67*a* and between the same and the front outer circumference area magnet 67*c*, and is thereby fixed thereto.

The rear center frame 65*a*, the front center frame 65*b*, the outer circumference frame 65*c* and the main frame 66 serve as a spacer that provides a gap so that the acoustic diaphragm 63*a* vibrating forward and backward is not made to collide with the rear magnet plate 61 and the front magnet plate 67.

Gaps provided between the trapezoidal small magnets 61*b*' that compose the rear base area magnet 61*b* are utilized as the sound passage ports 62*b*, and discharge sound generated from the rear side of the acoustic diaphragm 63*a* at the back of the electroacoustic transducer 60 together with the sound passage ports 64*b*. Also, the rear base area magnets 61*b* and the rear outer circumference area magnet 61*c* are installed so that the positions in the circumferential direction of the sound passage ports 62*b* and the sound passage ports 62*c* formed between the small magnets 61*b*' and the small magnets 61*c*' respectively are made coincident with each other. Sound generated from the rear side of the acoustic diaphragm 63*a* may be thus discharged also between the outer circumference frame 65*c* and the rear frame 64 by being bypassed through the sound passage ports 62*b* and the sound passage ports 62*c*.

In Embodiment 4, sound generated from the surface side of the acoustic diaphragm 63*a* is discharged through the sound passage ports as well as the sound generated from the rear side. That is, the gaps provided between the trapezoidal small magnets 67*b*' that compose the front base area magnet 67*b* are utilized as the sound passage ports 68*b*, and the gaps discharge sound at the front of the electroacoustic transducer 60 along with the sound passage ports 69*b* of the front frame 69. Also, the front base area magnet 67*b* and the front outer circumference area magnet 67*c* are installed so that the positions in the circumferential direction of the sound passage ports 68*b* and the sound passage ports 68*c* formed between the small magnets 67*b*' and the small magnets 67*c*' respectively are made coincident with each other, wherein sound generated from the surface side of the acoustic diaphragm 63*a* is discharged also between the main frame 66 and the front frame 69 by being bypassed through the sound passage ports 68*b* and the sound passage ports 68*c*.

The thin ring-shaped acoustic diaphragm 63*a* is such that two planar coils in which an electric conductor consisting of insulated copper-clad aluminum wire is spirally wound in one direction and cemented together by a silicone resin are adhered to each other. Also, lead wires (not illustrated) are connected to the respective planar coils as in Embodiments 1 and 2, and are connected to the terminal portions (not illustrated) to which a drive current is supplied from the outside.

Since there may be many cases where the acoustic diaphragm 63*a* is used for the low frequency range the amplitude of which becomes large, the inner circumference side supporting portion 63*b* and the outer circumference side supporting portion 63*c* having a corrugation portion formed therein are used. Since the materials of the inner circumference side supporting portion 63*b* and the outer circumference side supporting portion 63*c* are similar to those described in Embodiment 1, the description thereof is omitted.

Generally, where a magnet plate is provided at the front, there may be many cases where, in order to increase the effects thereof, the magnetization direction of the respective partial areas in the rear magnet plate 61 and the magnetization direction of the respective partial areas in the front magnet plate 67 are made plane-symmetrical to the vibration plane of the acoustic diaphragm 63*a*, respectively. Therefore, the magnetization directions of the rear base area magnet 61*b* and the front base area magnet 67*b* are made parallel to the vibration plane of the acoustic diaphragm 63*a* and is brought into the radius direction toward the center of the acoustic diaphragm 63*a*. Further, the magnetization direction of the rear center area magnet 61*a* is brought into the forward direction of the center axis of the acoustic diaphragm 63*a*, and the magnetization direction of the front center area magnet 67*a* is brought into the backward direction of the center axis of the acoustic diaphragm 63*a*. And, the magnetization direction of the rear outer circumference area magnet 61*c* is brought into the backward direction of the center axis of the acoustic diaphragm 63*a*, and the magnetization direction of the front outer circumference area magnet 67*c* is brought into the forward direction of the center axis of the acoustic diaphragm 63*a*.

Thus, by installing the front magnet plate 67 the magnetization direction of which is opposed to the rear magnet plate 61, the magnetic flux densities for effective action in the acoustic diaphragm 63*a* may be increased two times in comparison with the case of only the rear magnet plate 61.

Although, in Embodiment 4, the front magnet plate 67 the magnetization direction of which is opposed to the rear magnet plate 61 is installed at the front of the acoustic diaphragm 63*a*, such a structure is remarkably convenient in the electroacoustic transducer 60 that reproduces sound in the low frequency range.

Since the amplitude of the acoustic diaphragm 63*a* is increased in reproduction in the low frequency range, it is necessary to increase the gap of the rear magnet plate 61 and of the front magnet plate 67 with respect to the acoustic diaphragm 63*a* so that the acoustic diaphragm 63*a* is not brought into contact with the magnet plate. The greater the gap becomes, the lower the magnetic flux densities for effective action formed on the acoustic diaphragm 63*a* becomes. As a method for increasing the lowering magnetic flux densities for effective action, installation of the front magnet plate 67 at the front side of the acoustic diaphragm 63*a* is more efficient than thickening the rear magnet plate 61 at the rear side in view of increasing the magnet volume at a position close to the acoustic diaphragm 63*a*.

Further, where only the rear magnet plate 61 is arranged with respect to the acoustic diaphragm 63*a*, the magnetic flux densities for effective action are gradually lowered in line with the acoustic diaphragm 63*a* parting from the rear magnet plate 61. Therefore, the magnetic flux densities for effective action at respective positions of the acoustic diaphragm 63*a* being in vibration are made asymmetrical to the vibration direction with respect to the installation position of the acoustic diaphragm 63*a*. On the contrary, in Embodiment 4, since the front magnet plate 67 the magnetization direction of which is opposed to the rear magnet plate 61 is installed at the front of the acoustic diaphragm 63*a*, the magnetic flux densities for effective action at respective positions of the acoustic diaphragm 63*a* being in vibration are made symmetrical to the vibration direction with respect to the installation position of the acoustic diaphragm 63*a*. Thus, it is possible to prevent distortion that is produced due to a difference in the level of the magnetic flux densities for effective action in the vibration direction of the acoustic diaphragm 63*a*.

Next, a description is given of the influence on sound, which occurs by disposing the front magnet plate 67 at the front of the acoustic diaphragm 63*a*. Generally, where the front magnet plate 67 is disposed at the front of the acoustic diaphragm 63*a*, the space between the acoustic diaphragm 63*a* and the front magnet plate 67 becomes a cause for which sound discharged from the front of the acoustic diaphragm 63*a* is biased to a specific frequency and resonates therewith. There is such a tendency that, with respect to the space between the acoustic diaphragm 63*a* and the front magnet plate 67, the greater the cubic volume becomes, the less the resonance frequency becomes, and the smaller the area of the opening portion in the sound passage ports 68*b* and the sound passage ports 68*c* becomes, the stronger the resonance becomes.

However, even in a general example in which the outer diameter of the acoustic diaphragm 63*a* portion is 15 cm, and the gap between the acoustic diaphragm 63*a* and the front magnet plate 67 is 10 mm, there is no case where the resonance frequency becomes lower than 1000 Hz. Where the structure according to Embodiment 4 is adopted, the greater the amplitude of the acoustic diaphragm 63*a* becomes, the greater the effect thereof becomes. However, generally the frequency band in which the effect may be utilized is considerably lower than 1000 Hz described above. Accordingly, it is easy to use the electroacoustic transducer while avoiding the frequency that causes the above-described resonance, wherein no substantial problem occurs with such frequency.

Thus, there is no influence on the sound quality by resonance, etc., in the electroacoustic transducer 60 that reproduces sound in the low frequency range, and the method for installing the front magnet plate 67 at the front side of the acoustic diaphragm 63*a* may be effectively utilized.

With the electroacoustic transducer 60 according to Embodiment 4 of the present invention as described above, the following actions may be brought about in addition to the actions described in Embodiment 1.

(1) Although it is necessary to increase the gap between the acoustic diaphragm 63*a* and the rear magnet plate 61 in order to prevent the acoustic diaphragm 63*a*, the amplitude of which is increased when reproducing sound in the low frequency band, from being brought into contact, the magnetic flux densities for effective action, which are formed on the acoustic diaphragm 63*a*, are lowered. Since the magnet portion increased is apart from the acoustic diaphragm 63*a* even if the rear magnet plate 61 is thickened at the back side as a countermeasure, it is difficult to efficiently increase the magnetic flux densities for effective action. By installing the front magnet plate 67 at the front side of the acoustic diaphragm 63*a* in the electroacoustic transducer 60, the magnet volume may be increased at a position close to the acoustic diaphragm 63*a*, wherein it is possible to efficiently increase the magnetic flux densities for effective action.

(2) By installing the front magnet plate 67, the magnetization direction of which is opposed to the magnet plate 61, at the front of the acoustic diaphragm 63*a* in addition to the rear magnet plate 61, the magnetic flux densities for effective action at respective positions of the acoustic diaphragm 63*a* vibrating forward and backward may be made symmetrical to the vibration direction with respect to the installation position of the acoustic diaphragm 63*a*. Therefore, it is possible to prevent distortion that occurs due to a difference in the level of the magnetic flux densities for effective action in the vibration direction of the acoustic diaphragm 63*a*.

Embodiments 1 through 4 were described above. However, the present invention may be applicable without being limited thereto. For example, an electroacoustic transducer according to the present invention is not limited to specified sizes and material, which are described in the respective embodiments, and it does not matter that the magnetic polarities displayed may be brought into completely reverse polarities of the N and S polarities.

In addition, the above description was given mainly of the configuration, taking a speaker, which converts electric signals to sound, as an example. However, the invention may be applicable to a headphone, an earphone, etc., similar to the speaker. Furthermore, the invention may be applicable to a microphone, a acoustic wave sensor, etc., which converts received sound to electric signals.

EXAMPLES

Hereinafter, a detailed description is given of the present invention, using examples.

With respect to a magnet plate magnetized in three directions, which is formed with a configuration similar to Embodiment 1, an analysis was carried out through simulations on how the distribution of magnetic flux densities for effective action changes depending on the magnetization angles of respective partial areas.

Analysis Example 1

In an example using a magnet plate magnetized in three directions, the magnetization angles and sizes of the respective partial areas are under the same conditions as those of the magnet plate 11 in an electroacoustic transducer 10 according to Embodiment 1.

The respective partial areas of the magnet plate 11 in the electroacoustic transducer 10 according to Embodiment 1 are divided into small magnets, and data of the direction and strength of magnetization in the divided small areas are programmed. And, the strengths of magnetic fields contributing on the acoustic diaphragm 13*a* from the respective positions of the magnet plate 11 are calculated by using the Biot-Savart law, and are analyzed by the finite element method, thereby obtaining the distribution of the magnetic flux densities for effective action at the acoustic diaphragm 13*a*.

Comparative Example 1

This is an example in which the magnetization angle is set to 0 degrees using a magnet plate magnetized in the radius direction.

Although the magnetization angle θ of the base area magnet 11*b* was set to 0 degrees as in Embodiment 1, the magnetization angles of the center area magnet 11*a* and the outer circumference area magnet 11*c* were set to 0 degrees as in the base area magnet 11*b*. That is, in a case where the magnetization direction of all the partial areas was brought into the radius direction of the acoustic diaphragm 13*a* with the magnetization angle θ set to 0 degrees, the distribution of magnetic flux densities for effective action in the acoustic diaphragm 13*a* was obtained as in the analysis example 1.

Comparative Example 2

This is an example in which a magnet plate magnetized in two directions is used.

The distribution of magnetic flux densities for effective action in the acoustic diaphragm 13*a* was obtained under the same conditions as those of the comparative example 1 except that the magnetization angle θ at the center area magnet 11*a* side is set to +90 degrees as in Embodiment 1.

Comparative Example 3

This is an example in which a magnet plate magnetized in two directions is used.

The distribution of magnetic flux densities for effective action in the acoustic diaphragm 13*a* was obtained under the same conditions as those of the comparative example 1 except that the magnetization angle θ at the outer circumference area magnet 11*c* side is set to −90 degrees as in Embodiment 1.

Analysis Example 2

This is an example in which a magnet plate magnetized in three directions is used, wherein the magnetization angle of the respective partial areas is set to an angle by which the utilization efficiency of magnetic fluxes is maximized.

With respect to the magnet plate 11 in the electroacoustic transducer 10 according to Embodiment 1, the magnetization angle that may maximize the utilization efficiency of magnetic fluxes was obtained. Also, the angle changes according to the area of the electric conductor portion at the acoustic diaphragm 13*a*, the gap between the magnet plate 11 and the acoustic diaphragm 13*a*, and the width and thickness at the respective partial areas of the magnet plate 11.

The magnetization angle of a partial area, in which the value obtained by adding up the magnetic flux for effective action at an electric conductor of the acoustic diaphragm 13*a* by the area of the electric conductor is maximized, becomes the optimum magnetization angle to maximize the utilization efficiency of magnetic fluxes at the magnet plate 11 magnetized in three directions. Such an angle was obtained through trial and error while varying the magnetization angle θ for each of the types of the partial area in the simulations.

The results were that the angle be 23 degrees at the base area magnet 11*b*, 88 degrees at the center area magnet 11*a* and −90 degrees at the outer circumference area magnet 11*c*.

Figure 6:
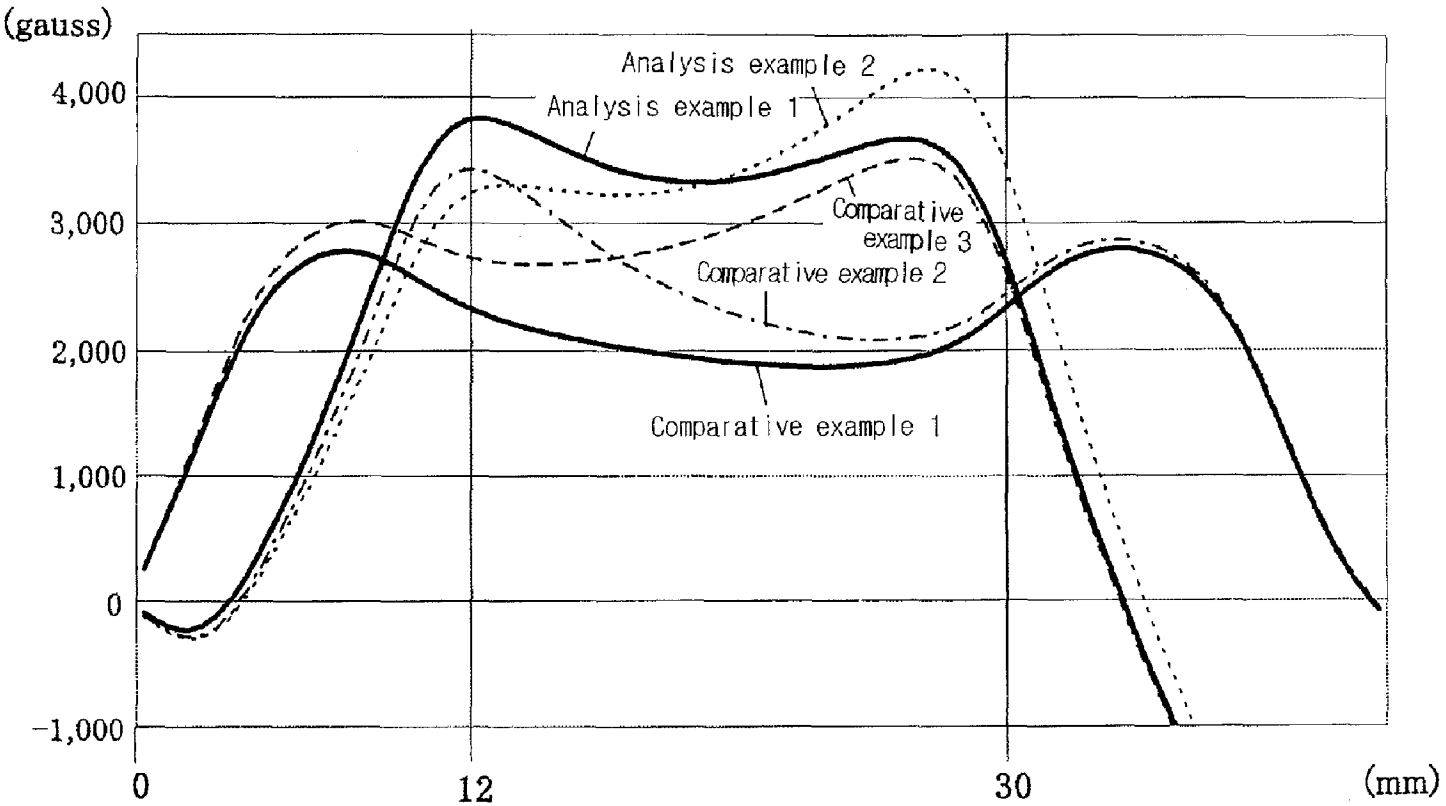
FIG. 6 is a view showing magnetic flux densities for effective action with respect to the radius direction of an acoustic diaphragm of the electroacoustic transducer according to Embodiment 1.

FIG. 6 is a view showing the magnetic flux densities for effective action with respect to the radius direction of an acoustic diaphragm of the electroacoustic transducer.

In FIG. 6, the abscissa expresses the distances from the center of the acoustic diaphragm 13*a*, and the ordinate expresses the magnetic flux densities for effective action at respective distances from the center of the acoustic diaphragm 13*a*. At the abscissa, the position of 12 mm is the inner circumference edge part of the electric conductor of the acoustic diaphragm 13*a*, and the position of 30 mm is the outer circumference edge part thereof. Therefore, a drive force operates on the electric conductor of the acoustic diaphragm 13*a* in proportion to the magnetic flux densities for effective action from the position of 12 mm to the position of 30 mm in the drawing.

In Comparative Example 2, the area at the inner circumference side is reduced and narrowed, in comparison with Comparative Example 1, in an area where the magnetic flux densities for effective action are high, by setting the magnetization angle θ of the center area magnet 11*a* to +90 degrees. However, the magnetic flux densities for effective action are entirely increased, and in particular the densities are increased at the inner circumference side.

In Comparative Example 3, the area at the outer circumference side is reduced and narrowed, in comparison with Comparative Example 1, in an area where the magnetic flux densities for effective action are high, by setting the magnetization angle θ of the outer circumference area magnet 11*c* to −90 degrees. However, the magnetic flux densities for effective action are entirely increased, and in particular the densities are increased at the outer circumference side.

The distribution of the magnetic flux densities for effective action according to Analysis Example 1 (Embodiment 1) has such features as obtained by synthesizing the features at the inner circumference side of Comparative Example 2 and the features at the outer circumference side of Comparative Example 3. That is, although the areas at the inner circumference side and the outer circumference side are reduced and narrowed at an area at which the magnetic flux densities for effective action are high, the magnetic flux densities for effective action are entirely and greatly increased.

And, if compared with the value obtained by adding up the magnetic fluxes for effective action between the radius of 12 mm and the radius of 30 mm, which are the electric conductor portions of the acoustic diaphragm 13*a*, by the area, Comparative Example 1, which uses a magnet plate magnetized in the radius direction with the magnetization angle θ in all the partial areas set to 0 degrees, is 58% when the distribution of the magnet plate 11 according to Analysis Example 1 (Embodiment 1) is made into a reference. Although such a phenomenon is not brought about if an acoustic diaphragm 13*a* having a large diameter is adopted, it is found that, if an acoustic diaphragm of a general diameter is used as the acoustic diaphragm 13*a*, such a low value is brought about.

As described above, where the magnetization direction of the base area magnet 11*b* is brought into the radius direction toward the center of the acoustic diaphragm 13*a* with the magnetization angle θ set to 0 degrees, it is possible to concentrate the magnetic flux for effective action by turning the magnetization angle θ of the center area magnet 11*a*, which becomes the center side of the base area magnet 11*b*, to the +90 degree side, and turning the magnetization angle θ of the outer circumference area magnet 11*c*, which becomes the outer circumference side of the base area magnet 11*b*, to the −90 degree side, wherein it is found that a distribution of remarkably high magnetic flux densities for effective action may be formed in a narrow range. Up until now, with respect to a magnet plate magnetized in the radius direction, there was a tendency that the magnetic fluxes for effective action are generally dispersed in a wide range and are distributed to a wider area than the area of an electric conductor of the acoustic diaphragm 13*a*. In such a case, it was found that a magnet plate magnetized in three directions and a magnet plate magnetized in two directions are remarkably effective means as a method for concentrating the magnetic fluxes for effective action in a necessary area and for increasing the densities thereof.

Also, although it is necessary to decrease the diameter of the acoustic diaphragm 13*a* to improve the directivity characteristics in line with the band reproduced by a speaker being drawn closer to a high frequency band, it is necessary to increase the magnetic flux density for effective action since the performance is lowered if the area of the diaphragm is reduced. In particular, in such cases, it was found that a magnet plate magnetized in three directions and a magnet plate magnetized in two directions are remarkably effective means.

Also, if, in the magnet plate in which the magnetization angle by which Analysis Example 2 is obtained is optimized, the value brought about by adding up the magnetic fluxes for effective action at an electric conductor of the acoustic diaphragm 13*a* by the area of the electric conductor is obtained, the value becomes 105% of the case of adopting the magnet plate 11 according to Analysis Example 1 (Embodiment 1).

Thus, in respective sizes adopted in Embodiment 1, the utilization efficiency of the magnetic fluxes is maximized when the magnetization angle θ of the center area magnet 11*a* is set to 88 degrees. And, the area of high magnetic flux densities for effective action is widened until the magnetization angle θ is reduced to approximately 20 degrees by decreasing the magnetization angle, and the utilization efficiency of the magnetic fluxes gradually becomes lower. And, at the outer circumference area magnet 11*c*, the utilization efficiency of the magnetic fluxes is maximized when the magnetization angle θ is set to −90 degrees. And, the utilization efficiency of the magnetic fluxes gradually becomes lower while the area of high magnetic flux densities for effective action is widened if the magnetization angle θ approaches 0 degrees.

Thus, where the features with respect to the distribution of magnetic flux densities for effective action are utilized for a speaker, a method for maximizing the value obtained by adding up the magnetic fluxes for effective action at the electric conductor of the acoustic diaphragm 13*a* by the area of the electric conductor will be selected in view of the performance. Although, in a speaker for a high frequency range and a mid frequency range, priority is placed on that a distribution of remarkably high magnetic flux densities for effective action may be formed in a narrow area since the area of the electric conductor portion of the acoustic diaphragm 13*a* is not able to be widened, in a low frequency range speaker, it is necessary to widen the area of the electric conductor portion of the acoustic diaphragm 13*a* so that the amplitude thereof is not increased. Thus, in order to determine the magnetization angle θ of the center area magnet 11*a* and the outer circumference area magnet 11*c*, it is necessary to take into consideration not only the height of the magnetic flux densities for effective action but also the width of the area having high magnetic flux densities for effective action. In addition, it is necessary to determine the magnetization angle θ by taking into consideration ease in magnetization when manufacturing a magnet, uniformity of distributions of magnetic flux densities for effective action, direction and strength of the magnetic force operating on the base area magnet 11*b*.

INDUSTRIAL APPLICABILITY

The present invention aims to put into practical use an electroacoustic transducer for a speaker, a headphone, an earphone, etc., which is capable of efficiently carrying out conversion from electric signals to sound at low distortion, or for a microphone, a acoustic wave sensor, etc., which is capable of efficiently carrying out conversion from sound to electric signals at low distortion, and which requires no special shape nor processing as a magnet, requires no minute setting of the magnetization direction, and sets a distribution of higher magnetic flux densities for effective action with respect to an electric conductor of an acoustic diaphragm than in a magnet plate magnetized in the radius direction although the production process thereof is remarkably simple as in a magnet plate magnetized in the radius direction.

The invention claimed is:

1. An electroacoustic transducer including a magnet plate the entirety of which is formed to be disk-shaped or ring-shaped, and a disk-shaped or ring-shaped acoustic diaphragm provided with a planar coil disposed parallel to the magnet plate and formed by spirally winding an electric conductor;

wherein the electroacoustic transducer is provided with at least any one of a center area magnet magnetized so that a component parallel to the center axis of the acoustic diaphragm is turned into the forward direction of the acoustic diaphragm at the position that becomes the center side of a base area magnet and an outer circumference area magnet magnetized so that a component parallel to the center axis of the acoustic diaphragm is turned into the backward direction of the acoustic diaphragm at the position that becomes the outer circumference side of the base area magnet, in addition to the base area magnet magnetized so that a component parallel to the vibration plane of the acoustic diaphragm is turned into the radius direction toward the center of the acoustic diaphragm with respect to the magnetization direction of respective partial areas of a magnet plate.

2. An electroacoustic transducer including a magnet plate the entirety of which is formed to be disk-shaped or ring-shaped, and a disk-shaped or ring-shaped acoustic diaphragm provided with a planar coil disposed parallel to the magnet plate and formed by spirally winding an electric conductor;

wherein the electroacoustic transducer is provided with at least any one of a center area magnet magnetized so that a component parallel to the center axis of the acoustic diaphragm is turned into the backward direction of the acoustic diaphragm at the position that becomes the center side of a base area magnet and an outer circumference area magnet magnetized so that a component parallel to the center axis of the acoustic diaphragm is turned into the forward direction of the acoustic diaphragm at the position that becomes the outer circumference side of the base area magnet, in addition to the base area magnet magnetized so that a component parallel to the vibration plane of the acoustic diaphragm is turned into the radius direction toward the outer circumference of the acoustic diaphragm with respect to the magnetization direction of respective partial areas of a magnet plate.

3. The electroacoustic transducer according to claim 1 or claim 2, including a frame for fixing at least any one of the center area magnet and the outer circumference area magnet at the side that is opposite to the side where the acoustic diaphragm is installed at the magnet plate, wherein the base area magnet is fixed at the frame by a magnetic force that the center area magnet or the outer circumference area magnet presses the base area magnet to the frame side.

4. The electroacoustic transducer according to claim 1 or claim 2, including at least any one of the front center area magnet disposed at a position symmetrical to the center area magnet with the acoustic diaphragm inserted therebetween and magnetized in the direction plane-symmetrical to the magnetization direction of the center area magnet with respect to the vibration plane of the acoustic diaphragm and the front outer circumference area magnet disposed at a position symmetrical to the outer circumference area magnet with the acoustic diaphragm inserted therebetween and magnetized in the direction plane-symmetrical to the magnetization direction of the outer circumference area magnet with respect to the vibration plane of the acoustic diaphragm.

5. The electroacoustic transducer according to claim 4, including a front base area magnet disposed at a position symmetrical to the base area magnet with the acoustic diaphragm inserted therebetween and magnetized in the direction plane-symmetrical to the magnetization direction of the base area magnet with respect to the vibration plane of the acoustic diaphragm.

6. The electroacoustic transducer according to claim 1 or claim 2, wherein at least any one of the base area magnet, the outer circumference area magnet and the center area magnet of the magnet plate is provided with sound passage ports through which sound generated outside or inside is caused to pass.

7. An electroacoustic transducer in which a plurality of electroacoustic transducers according to claim 1 or claim 2 are concentrically disposed with the sizes thereof made different from each other.

* * * * *